US007717551B2

(12) United States Patent
Kadomatsu et al.

(10) Patent No.: US 7,717,551 B2
(45) Date of Patent: May 18, 2010

(54) IMAGE FORMING METHOD AND IMAGE FORMING APPARATUS

(75) Inventors: Tetsuzo Kadomatsu, Kanagawa (JP); Masaaki Konno, Kanagawa (JP); Toshiyuki Makuta, Fujinomiya (JP)

(73) Assignee: Fujifilm Corporation, Tokyo (JP)

( * ) Notice: Subject to any disclaimer, the term of this patent is extended or adjusted under 35 U.S.C. 154(b) by 980 days.

(21) Appl. No.: 11/483,657

(22) Filed: Jul. 11, 2006

(65) Prior Publication Data

US 2007/0013759 A1 Jan. 18, 2007

(30) Foreign Application Priority Data

Jul. 15, 2005 (JP) ..... 2005-207212

(51) Int. Cl.
*B41J 2/01* (2006.01)

(52) U.S. Cl. ..... 347/102; 347/100

(58) Field of Classification Search ..... 347/102, 347/101, 100, 95, 96
See application file for complete search history.

(56) References Cited

U.S. PATENT DOCUMENTS

2007/0013759 A1* 1/2007 Kadomatsu et al. ..... 347/102

FOREIGN PATENT DOCUMENTS

JP 10-287035 A 10/1998
JP 2000-135781 A 5/2000
JP 2003-12971 A 1/2003

* cited by examiner

*Primary Examiner*—Manish S Shah
(74) *Attorney, Agent, or Firm*—Birch, Stewart, Kolasch & Birch, LLP

(57) ABSTRACT

The image forming method includes the steps of: depositing a first liquid containing at least a dispersion inhibitor, a polymerization initiator, and a high-boiling-point organic solvent, onto an image forming region of a recording medium where an image is to be formed according to image data, and onto a peripheral region of the image forming region; ejecting a second liquid containing at least a radiation-curable polymer compound and a coloring material, onto the recording medium according to the image data after the first liquid is deposited onto the image forming region and the peripheral region of the image forming region; ejecting a third liquid containing at least a radiation-curable polymer compound, onto at least the peripheral region of the image forming region after the first liquid is deposited onto the image forming region and the peripheral region of the image forming region, the third liquid having a transparent color, the same color as the recording medium, or a similar color to the recording medium; and irradiating radiation onto the first liquid, the second liquid and the third liquid on the recording medium.

10 Claims, 11 Drawing Sheets

IMAGE FORMING METHOD AND IMAGE FORMING APPARATUS

BACKGROUND OF THE INVENTION

1. Field of the Invention

The present invention relates to an image forming method and an image forming apparatus, and more particularly to image formation technology in an image forming apparatus for forming a desired image on a medium by reacting an image forming liquid such as ink with a treatment liquid and fixing the image forming liquid onto the medium.

2. Description of the Related Art

In recent years, inkjet recording apparatuses have become common as image forming apparatuses which form images, such as photographic images, documents, or the like, on a medium. An inkjet recording apparatus forms a desired image on a medium by ejecting droplets of ink from nozzles, by driving ejection elements provided in the print head in accordance with data.

Depending on the type of medium and the type of ink, when the ejected ink droplets permeate into the media, bleeding or spreading of the formed dots may occur, thus leading to a marked decline in the quality of the image formed. In order to prevent image deterioration caused by bleeding or spreading of dots in this way, a system has been proposed which uses a radiation-curable ink whose curing (fixing) is promoted by the irradiation of radiation, such as ultraviolet light or an electron beam, onto the ink droplets ejected onto the media.

Japanese Patent Application Publication No. 10-287035 discloses an inkjet recording method, a recorded object, and an inkjet recording apparatus where printing is carried out by depositing a reactive solution containing a photopolymerization initiator, and an ink composition containing an acrylate monomer and an oligomer, onto a recording medium, and thereby print bleeding and print non-uniformities are suppressed so as to prevent color bleeding, which is uneven color mixing occurring at the boundary regions between the different colors used in the color inkjet recording method.

Japanese Patent Application Publication No. 2003-12971 discloses an inkjet recording method whereby printing is carried out by depositing an ink composition containing 30% to 98% (wt %: weight percentage) of a polymer compound and a coloring material, and a reactive liquid containing a polymer compound and a polymerization initiator, onto a recording medium, and thereby print bleeding and print non-uniformities are suppressed so as to prevent color bleeding, which is uneven color mixing at the boundary regions between the different colors in the color inkjet recording method.

Furthermore, Japanese Patent Application Publication No. 2000-135781 discloses an inkjet recording apparatus, an image forming method, and ink composition where at least a portion of the image is formed by mixing and curing a first ink composition and a second ink composition, in such a manner that a clear and highly detailed image can be recorded, even onto normal paper which has not received special processing.

However, according to a method whereby an ink droplet is ejected onto a treatment liquid deposited onto the media, the surface of the treatment liquid on the media onto which the ink droplets are ejected is not a completely flat surface, but rather the perimeter sections thereof in particular have a gradient, and hence the ink droplets deposited onto the treatment liquid may move due to this gradient. In this way, the dots are not formed at the prescribed positions, due to the movement of the ink arising at the perimeter sections of the treatment liquid, and this affects the quality of the image formed on the media.

Furthermore, if an organic solvent having the high boiling point is used for the solvent of the treatment liquid, then the unreacted treatment liquid which is not incorporated into the polymer compound (monomer, oligomer, or the like) in the ink, does not cure and remains on the surface of the media. Moreover, if the treatment liquid is deposited over a broader range than the ink droplet ejection range in such a manner that an ink droplet is not ejected onto the perimeter sections of the treatment liquid, then the amount of unreacted treatment liquid remaining on the surface of the media increases.

Japanese Patent Application Publications No. 10-287035, No. 2003-12971, and No. 2000-135781 do not disclose or suggest a concrete method for preventing landing interference in the case of high-speed printing. Landing interference means, for example, a phenomenon that a liquid droplet of ink moves and becomes fixed at a position different from its originally intended landing position or a phenomenon that the shape of the liquid ink droplet is deformed and disrupted, due to combination between liquid ink droplets on the surface of the recording medium, before fixing, and immediately after the ink droplets have landing on the recording medium. If landing interference occurs on the recording medium, in the cases of ink droplets of the same color, a density non-uniformity may become visible, and the line quality may decline. Furthermore, in the cases of inks of different colors, color bleeding may occur.

SUMMARY OF THE INVENTION

The present invention is conceived in view of the aforementioned circumstances, an object thereof being to provide an image forming method and an image forming apparatus, in order that a desirable image can be formed on a medium, by preventing the occurrence of image degradation due to landing interference on the medium, especially in the case of high-speed printing.

In order to attain the aforementioned object, the present invention is directed to an image forming method comprising the steps of: depositing a first liquid containing at least a dispersion inhibitor, a polymerization initiator, and a high-boiling-point organic solvent, onto an image forming region of a recording medium where an image is to be formed according to image data, and onto a peripheral region of the image forming region; ejecting a second liquid containing at least a radiation-curable polymer compound and a coloring material, onto the recording medium according to the image data after the first liquid is deposited onto the image forming region and the peripheral region of the image forming region; ejecting a third liquid containing at least a radiation-curable polymer compound, onto at least the peripheral region of the image forming region after the first liquid is deposited onto the image forming region and the peripheral region of the image forming region, the third liquid having a transparent color, the same color as the recording medium, or a similar color to the recording medium; and irradiating radiation onto the first liquid, the second liquid and the third liquid on the recording medium.

According to this aspect of the present invention, the second liquid ejected on the basis of the image data is deposited onto the first liquid, and consequently it is possible to prevent landing interference of the second liquid by means of the high-boiling-point organic solvent and the dispersion inhibitor which are components of the first liquid. If the deposition region of the first liquid corresponds to the droplet ejection region of the second liquid and the peripheral region of the droplet ejection region of the second liquid, then the second liquid lands on an area where the surface of the first liquid is flat, thus preventing displacement of the second liquid. Accordingly, it is possible to obtain a desirable image without the occurrence of displacement of the dot formed by the second liquid.

Here, the displacement of the landing position of the second liquid means a phenomenon which, rather than being caused by the variation in the flight direction of the second liquid, is caused by the second liquid moving over an inclined section of the first liquid, when the second liquid lands on the section having an incline at a boundary section of the first liquid, for example.

Furthermore, a third liquid, which is transparent, of the same color type as the recording medium, or of the similar color type to the recording medium, is ejected onto the peripheral region of the image forming region where the second liquid is not present, of the region where the first liquid has been deposited, and this liquid is cured reliably by being irradiated with radiation. Hence it is possible to prevent the remnant of surplus liquid on the recording medium.

A first liquid deposition region onto which the first liquid is deposited includes the image forming region onto which a second liquid are ejected, and the peripheral region of this image forming region. For example, if there is a cutaway section in the image to be formed, then there is a first liquid deposition region in this cutaway section as well.

Here, an "image" indicates an image in a broad sense, including a text character, a symbol, a figure, a pattern, or the like.

The recording medium is a medium which receives the deposited first liquid in the first liquid deposition step, the second liquid ejected in the second liquid droplet ejection step, and the third liquid ejected in the third liquid droplet ejection step. The recording medium may include various types of media, such as continuous paper, cut paper, sealed paper, a resin sheet such as a PHP sheet, film, cloth, or the like, irrespective of material or shape.

Preferably, the third liquid contains a polymerization initiator.

According to this aspect of the present invention, a polymerization initiator is included in the third liquid, and thereby it is possible to cure the first liquid and the third liquid reliably by irradiating radiation onto the mixed liquid of the first liquid and the third liquid.

In order to attain the aforementioned object, the present invention is also directed to an image forming method comprising the steps of: depositing a first liquid containing at least a dispersion inhibitor and a high-boiling-point organic solvent, onto an image forming region of a recording medium where an image is to be formed according to image data, and onto a peripheral region of the image forming region; ejecting a second liquid containing at least a radiation-curable polymer compound, a polymerization initiator, and a coloring material, onto the recording medium according to the image data after the first liquid is deposited onto the image forming region and the peripheral region of the image forming region; ejecting a third liquid containing at least a radiation-curable polymer compound and a polymerization initiator, onto at least the peripheral region of the image forming region after the first liquid is deposited onto the image forming region and the peripheral region of the image forming region, the third liquid having a transparent color, the same color as the recording medium, or a similar color to the recording medium; and irradiating radiation onto the first liquid, the second liquid and the third liquid on the recording medium.

According to this aspect of the present invention, each of the second liquid and the third liquid includes a polymerization initiator. Thereby it is possible to cure the second liquid and the third liquid reliably, even if the first liquid does not contain a polymerization initiator.

Preferably, a timing of ejecting the third liquid onto at least the peripheral region of the image forming region is substantially the same as a timing of ejecting the second liquid onto the recording medium, or is after the timing of ejecting the second liquid onto the recording medium.

"Being substantially the same as a timing of ejecting the second liquid" include a state where the second liquid ejection step is being carried out on any part of the recording medium while the second liquid ejection step has been completed and the third liquid droplet ejection step is being carried out in another part of the recording medium. Of course, it also includes an embodiment in which the third liquid ejection step is carried out simultaneously with respect to the region subject to the second droplet ejection step.

Preferably, a timing of ejecting the second liquid onto the recording medium is substantially the same as a timing of ejecting the third liquid onto at least the peripheral region of the image forming region, or is after the timing of ejecting the third liquid onto at least the peripheral region of the image forming region.

According to these aspects of the present invention, when the second liquid is ejected onto the image forming region after the third liquid have been ejected onto the peripheral region of the image forming region, then it is possible to surround the periphery of the image forming region with a reactive product of the first liquid and the third liquid, and hence spreading of the second liquid deposited onto the first liquid can be prevented.

In order to attain the aforementioned object, an apparatus for achieving the above methods is also conceived. The present invention is also directed to an image forming apparatus comprising: a first liquid deposition device depositing a first liquid containing at least a dispersion inhibitor and a high-boiling-point organic solvent, onto an image forming region of a recording medium where an image is to be formed according to image data, and onto a peripheral region of the image forming region; a second liquid ejection device ejecting a second liquid containing at least a radiation-curable polymer compound, a polymerization initiator, and a coloring material, onto the recording medium according to the image data after the first liquid is deposited onto the image forming region and the peripheral region of the image forming region; a third liquid ejection device ejecting a third liquid containing at least a radiation-curable polymer compound and a polymerization initiator, onto at least the peripheral region of the image forming region after the first liquid is deposited onto the image forming region and the peripheral region of the image forming region, the third liquid having a transparent color, the same color as the recording medium, or a similar color to the recording medium; and a radiation irradiation device irradiating radiation onto the first liquid, the second liquid and the third liquid on the recording medium.

According to this aspect of the invention, a polymerization initiator is included only in the first liquid. Hence, even if a portion of the radiation from the radiation irradiation device reaches the second liquid ejection device and the third liquid ejection device, a curing reaction of the second liquid in the second liquid ejection device and a curing reaction of the third liquid in the third liquid ejection device do not occur, and therefore liquid blockages in the second liquid ejection device and the third liquid ejection device can be prevented.

For the first liquid deposition device, it is possible to use an application device which applies the first liquid onto the recording medium, a liquid droplet device which ejects a droplet of the first liquid from a nozzle, or the like. Furthermore, for the second liquid ejection device and the third liquid ejection device, it is possible to use an inkjet head which ejects ink onto the recording medium. Of course, it is also possible to use the aforementioned inkjet head as the first liquid deposition device.

Examples of an inkjet head include a head having an ejection hole (nozzle) from which a liquid droplet is ejected, a liquid chamber (pressure chamber) accommodating liquid to be ejected in the form of a droplet from the ejection hole, and an actuator provided on the liquid chamber for pressurizing the liquid inside the liquid chamber.

The inkjet head may be a line type head having a row of nozzles of a length corresponding to the full width of the recording medium (the width of the possible ink droplet ejection region of the recording medium), or a serial type head which uses a short head having an ejection hole row of a length that does not reach the full width of the recording medium. The serial type head may scan in the breadthways direction of the recording medium.

A line type inkjet head may be formed to a length corresponding to the full width of the recording medium by combining short heads having rows of ejection holes which do not reach a length corresponding to the full width of the recording medium, these short heads being joined together in a staggered matrix fashion.

Preferably, the third liquid contains a polymerization initiator.

According to this aspect of the present invention, a polymerization initiator is included in the third liquid, and hence the first liquid and the third liquid react together reliably. Consequently, when radiation is irradiated onto this reaction product, the third liquid can be cured reliably.

In order to attain the aforementioned object, the present invention is also directed to an image forming apparatus, comprising: a first liquid deposition device depositing a first liquid containing at least a dispersion inhibitor and a high-boiling-point organic solvent, onto an image forming region of a recording medium where an image is to be formed according to image data, and onto a peripheral region of the image forming region; a second liquid ejection device ejecting a second liquid containing at least a radiation-curable polymer compound, a polymerization initiator, and a coloring material, onto the recording medium according to the image data after the first liquid is deposited onto the image forming region and the peripheral region of the image forming region; a third liquid ejection device ejecting a third liquid containing at least a radiation-curable polymer compound and a polymerization initiator, onto at least the peripheral region of the image forming region after the first liquid is deposited onto the image forming region and the peripheral region of the image forming region, the third liquid having a transparent color, the same color as the recording medium, or a similar color to the recording medium; and a radiation irradiation device irradiating radiation onto the first liquid, the second liquid and the third liquid on the recording medium.

According to this aspect of the present invention, a polymerization initiator is included in the second liquid and the third liquid, and hence it is possible to cure the second liquid and the third liquid reliably even if the first liquid does not contain a polymerization initiator.

According to the present invention, by taking the deposition region of the first liquid to be the ejection region of the second liquid where second liquid is ejected on the basis of the image data, and the peripheral region of the ejection region of the second liquid, then the second liquid lands on an area where the surface of the first liquid is flat. Hence displacement of the landing position of the second liquid is prevented, and a desirable image can be obtained. Furthermore, by ejecting a third liquid which is transparent, of the same color type as the recording medium, or similar color type to the recording medium, onto the part where the second liquid is not present in the region where the first liquid has been deposited, and by irradiating radiation on the first liquid, the second liquid and the third liquid, it is possible to cure these liquids reliably, and therefore surplus liquid does not remain on the recording medium.

BRIEF DESCRIPTION OF THE DRAWINGS

The nature of this invention, as well as other objects and advantages thereof, will be explained in the following with reference to the accompanying drawings, wherein.

DETAILED DESCRIPTION OF THE PREFERRED EMBODIMENTS

General Composition of Inkjet Recording Apparatus

Figure 1:
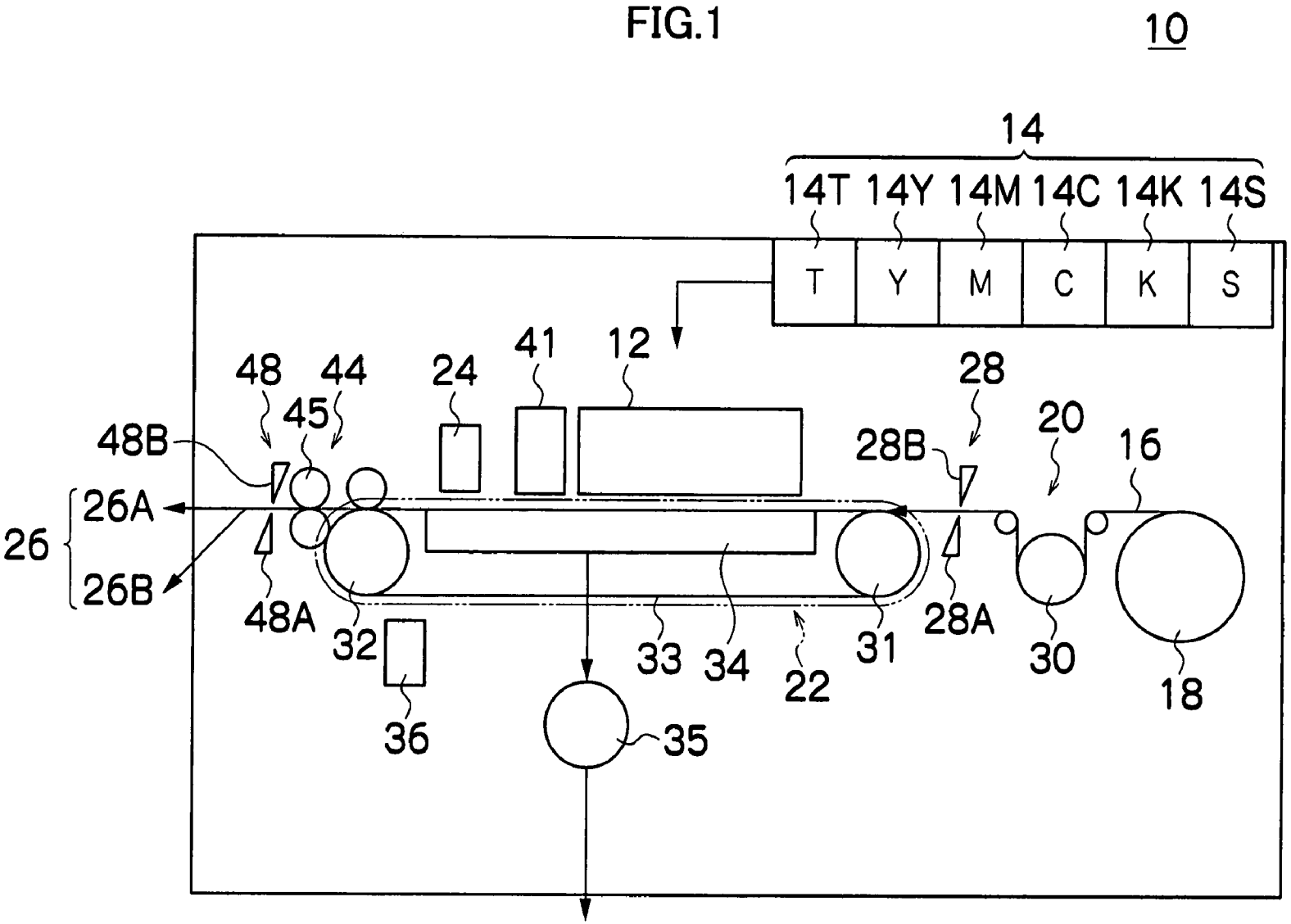
FIG. 1 is a general schematic drawing of an inkjet recording apparatus according to an embodiment of the present invention.

FIG. 1 is a diagram of the general composition of an inkjet recording apparatus relating to an embodiment of the present invention. As shown in FIG. 1, the inkjet recording apparatus 10 comprises: a print unit 12 having a plurality of inkjet heads (indicated by reference numerals 12K, 12C, 12M, and 12Y in FIG. 2) provided for ink colors of black (K), cyan (C), magenta (M), and yellow (Y), respectively, a treatment liquid head (indicated by reference numeral 12S in FIG. 2) corresponding to the treatment liquid (S) for avoiding landing interference between the inks of the respective colors, and a transparent ink head (indicated by reference numeral 12T in FIG. 2) corresponding to a transparent ink (T) which does not contain coloring material; an ink storing and loading unit 14 for storing inks to be supplied to the print heads; a paper supply unit 18 for supplying a recording medium (recording paper) 16; a decurling unit 20 removing curl in the recording medium 16, such as recording paper; a suction belt conveyance unit 22 disposed facing the nozzle surface (ink ejection surface) of the print unit 12, for conveying the recording medium 16 while keeping the recording medium 16 flat; a print determination unit 24 for reading the printed result produced by the print unit 12; and a paper output unit 26 for outputting recorded recording paper (printed matter) to the exterior.

The ink storing and loading unit 14 comprises a treatment liquid supply tank 14S which stores a treatment liquid (first liquid) to be ejected from the treatment liquid head, and ink supply tanks 14K, 14C, 14M, 14Y and 14T which stores color inks (second liquids) and a transparent ink (third liquid) respectively. These tanks are connected to the treatment liquid head and the ink heads of the colors via required channels, respectively. The ink storing and loading unit 14 also comprises a warning device (for example, a display device or an alarm sound generator) for warning when the remaining amount of any ink is low, and has a mechanism for preventing loading errors between different colors.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording medium can be used, it is preferable that an information recording medium such as a bar code and a wireless tag containing information about the type of media is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording medium 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording medium 16 has a curl in which the surface on which the print is to be made is slightly round outward.

In the case of the configuration in which roll paper is used as the recording medium 16, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording medium 16, and a round blade 28B, which moves along the stationary blade 28A. The stationary blade 28A is disposed on the reverse side of the printed surface of the recording medium 16, and the round blade 28B is disposed on the printed surface side across the conveyor pathway. When cut papers are used, the cutter 28 is not required.

The decurled and cut recording medium 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor installation face of the print determination unit 24 forms a horizontal plane (flat plane).

The belt 33 has a width that is greater than the width of the recording medium 16, and a plurality of suction apertures (not shown) are formed on the belt surface. A suction chamber 34 is disposed in a position facing the sensor installation surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording medium 16 is held on the belt 33 by suction.

The belt 33 is driven in the anti-clockwise direction in FIG. 1 by the motive force of a motor 88 (shown in FIG. 6) being transmitted to at least one of the rollers 31 and 32, which the belt 33 is set around, and the recording medium 16 held on the belt 33 is conveyed from right to left in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

Each of the color inks and the transparent ink used in the inkjet recording apparatus 10 according to the present embodiment contains at least one polymer compound of an ultraviolet-curable monomer, an ultraviolet-curable oligomer, and a combination of these which have properties that the curing reaction of an aggregate in the polymer compounds is promoted by being mixed with a polymerization initiator containing a treatment liquid and being given energy, such as irradiation of ultraviolet light.

In other words, if ultraviolet light is irradiated from an ultraviolet light source 41 provided on the downstream side of the print unit 12 (i.e., after the print unit 12) in a state where the polymer compound contained in the ink is mixed with the polymerization initiator contained in the treatment liquid, then radicals are generated from the polymerization initiator, a polymerization reaction occurs, and the mixed liquid of ink and treatment liquid cures. The details of the inks used in the present embodiment, and the details of the ultraviolet light source 41 are described hereinafter.

The print determination unit 24 provided on the downstream side of the ultraviolet light source 41 (i.e., after the ultraviolet light source 41) has an image sensor for capturing the ink droplet deposition result of the print unit 12, and functions as a device to check for ejection abnormalities, such as blocking of the nozzles in the print unit 12 from the recorded image read in by the image sensor.

The print determination unit 24 of the present embodiment is configured with at least a line sensor having photoelectric transducing elements with a width that is greater than the ink-droplet ejection width (image recording width) of the heads 12K, 12C, 12M, and 12Y. This line sensor has a color separation line CCD sensor including a R (red) light receiving element row composed of photoelectric transducing elements (pixels) arranged in a line provided with an R filter, a G (green) light receiving element row with a G filter, and a B (blue) light receiving element row with a B filter. Instead of a line sensor, it is possible to use an area sensor composed of light receiving elements which are arranged two-dimensionally.

The print determination unit 24 reads a test pattern image (or an actual image) printed by the heads 12K, 12C, 12M, and 12Y for the respective colors, and the ejection of each head is determined. The ejection determination includes the presence of the ejection, measurement of the dot size, and measurement of the dot deposition position.

The printed matter generated in this manner is output from the paper output unit 26. The target print (i.e., the result of printing the target image) and the test print are preferably output separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Compositional Example of the Print Unit

Figure 2:
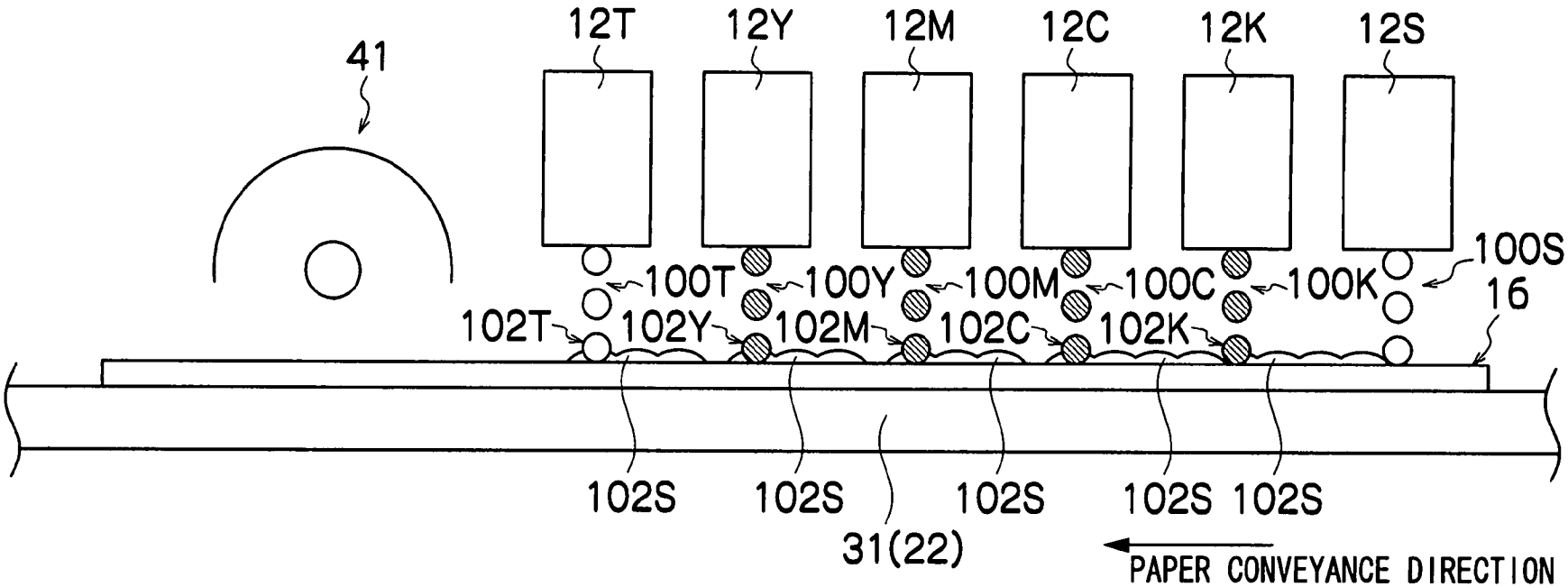
FIG. 2 is an enlarged drawing showing the composition of the print unit shown in FIG. 1.

FIG. 2 shows the details of the composition of the print unit 12. The print unit 12 comprises the treatment liquid head 12S corresponding to the treatment liquid, inkjet heads 12K, 12C, 12M and 12Y corresponding to inks of respective colors of black, cyan, magenta and yellow, and the inkjet head 12T corresponding to transparent ink (T). Below, the treatment liquid head 12S, the inkjet head 12K, 12C, 12M, 12Y and the inkjet head 12T may be described simply as a "head", such as the head 12S.

Figure 3:
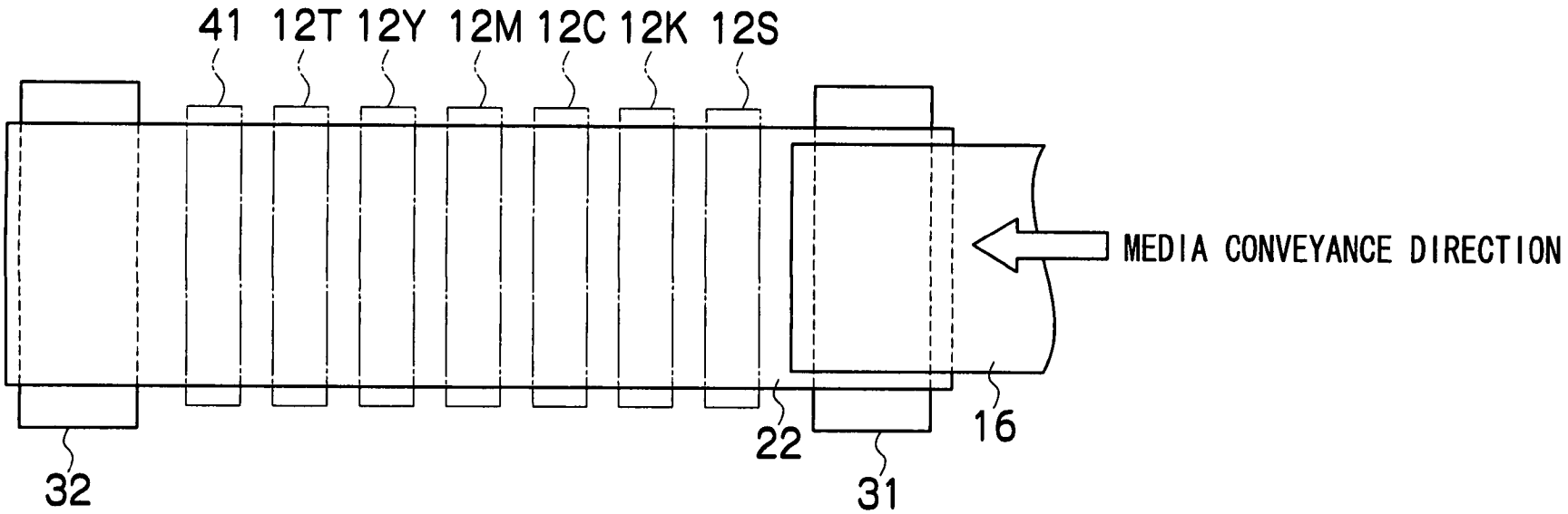
FIG. 3 is a principal plan diagram of the peripheral area of a print unit in the inkjet recording apparatus illustrated in FIG. 1.

The heads 12S, 12K, 12C, 12M, 12Y and 12T of the print unit 12 are full line heads having a length corresponding to the maximum width of the recording medium 16 used with the inkjet recording apparatus 10, and comprising a plurality of nozzles for ejecting ink arranged on a nozzle face through a length exceeding at least one edge of the maximum-size recording medium (namely, the full width of the printable range) (see FIG. 3).

The heads 12S, 12K, 12C, 12M, 12Y and 12T are disposed in sequence in the order corresponding to treatment liquid (S), black (K), cyan (C), magenta (M), yellow (Y) and transparent ink (T), from the upstream side, following the direction of conveyance of the recording medium 16 (the paper feed direction shown in FIGS. 2 and 3), and the respective heads 12S, 12K, 12C, 12M, 12Y and 12T are fixed so as to extend in line with a direction substantially perpendicular to the paper feed direction.

A color image can be formed on the recording medium 16 by ejecting inks of different colors from the heads 12S, 12K, 12C, 12M, 12Y and 12T, respectively, onto the recording medium 16 while the recording medium 16 is conveyed by the suction belt conveyance unit 22.

By adopting a configuration in which full line heads 12S, 12K, 12C, 12M, 12Y and 12T having nozzle rows covering the full paper width are separately provided according to liquids in this way, it is possible to record an image on the full surface of the recording medium 16 by performing just one operation of relative movement between the recording medium 16 and the print unit 12, in the paper conveyance direction (the sub-scanning direction), (in other words, by means of one sub-scanning action). Higher-speed printing is thereby made possible and productivity can be improved in comparison with a shuttle type head configuration in which a recording head moves back and forth reciprocally in the direction which is perpendicular to the paper conveyance direction.

After droplets of the treatment liquid 100S have been ejected onto a prescribed region of the recording medium 16 from the head 12S on the furthest upstream side in terms of the paper feed direction, droplets of K ink 100K, C ink 100C, M ink 100M, and Y ink 100Y are ejected in sequence from the respective color heads 12K, 12C, 12M, 12Y, onto the treatment liquid deposition region (not shown in FIG. 2; and indicated by reference numeral 200 in FIGS. 7A and 7B and the like) where treatment liquid 102S has been deposited on the recording medium 16. Moreover, after droplets of the K, C, M and Y inks have been ejected, droplets of transparent ink 100T are ejected from the transparent ink head 12T onto at least the sections of the treatment liquid deposition region where droplets the K, C, M and Y inks have not been ejected. In FIG. 2, the treatment liquid deposited on the recording medium is indicated by reference numeral 102S.

In this way, when droplets of K, C, M, Y inks 102K, 102C, 102M, 102Y and transparent ink 100T are ejected onto the treatment liquid 102S deposited on the recording medium 16, then landing interference between the K, C, M, Y inks 102K, 102C, 102M and 102Y, is prevented, due to the effects of the treatment liquid 102S.

Although a configuration with the four standard colors of K, C, M and Y is described in the present embodiment, the combination of the ink colors and the number of colors are not limited to those. Light and/or dark inks, and special color inks can be added as required. For example, a configuration is possible in which inkjet heads for ejecting light-colored inks, such as light cyan and light magenta, and dark inks such as dark yellow, are added. Furthermore, there are no particular restrictions of the sequence in which the heads of respective colors are arranged.

Moreover, it is also possible to provide a plurality of treatment liquid heads corresponding to a plurality of treatment liquids of different types (for example, treatment liquids having different physical properties, such as viscosity, or treatment liquids having different compositions), and it is also possible to adopt a composition in which a plurality of treatment liquids can be ejected from one head.

Structure of the Head

Next, the structure of a head is described below. The heads 12K, 12C, 12M and 12Y of the respective ink colors have the same structure, and a reference numeral 50 is hereinafter designated to any of the heads.

Figure 4A:
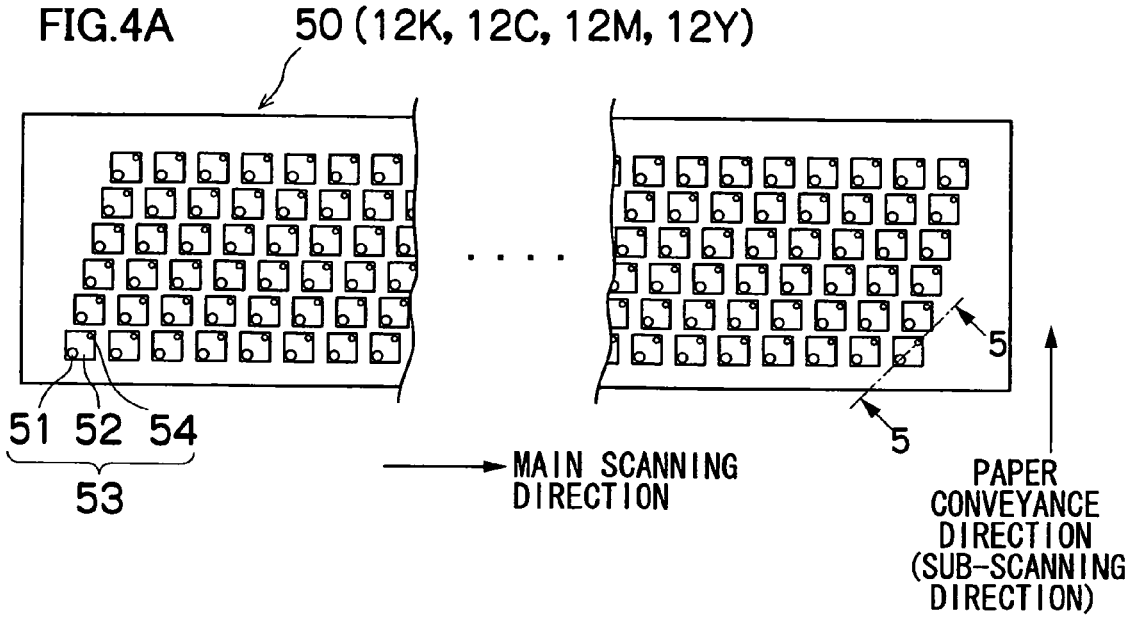
FIGS. 4A to 4C are plan view perspective diagrams showing an embodiment of the composition of a print head.
Figure 4B:
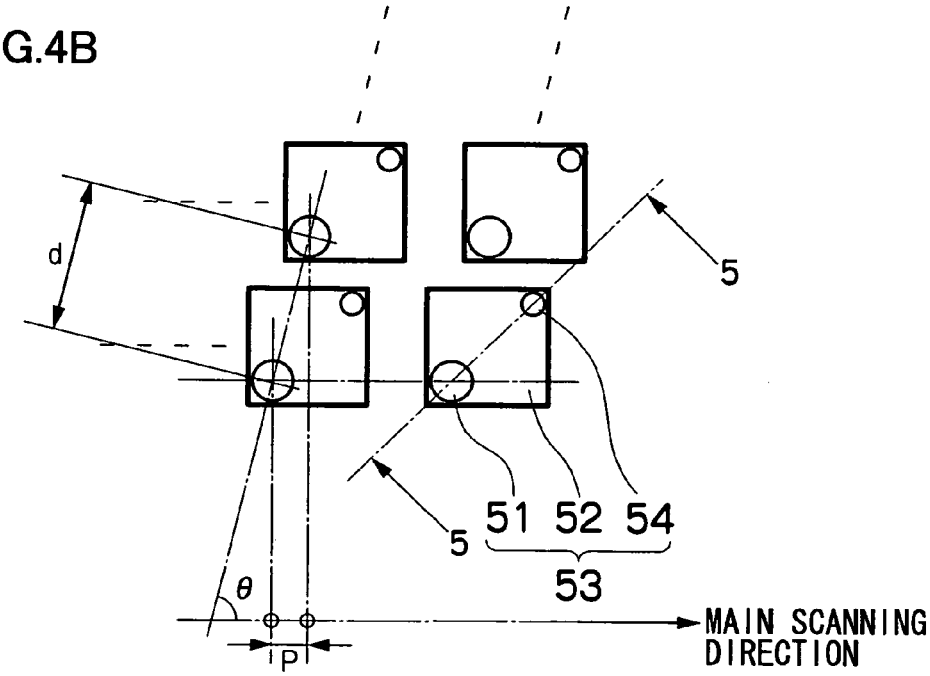
Figure 4C:
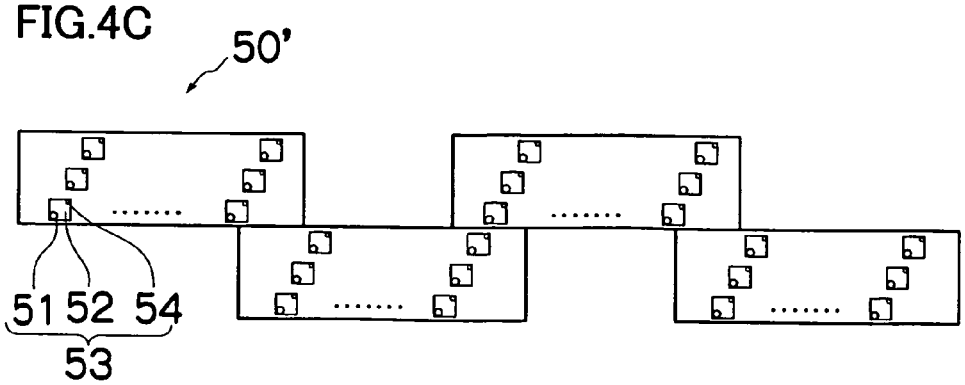
Figure 5:
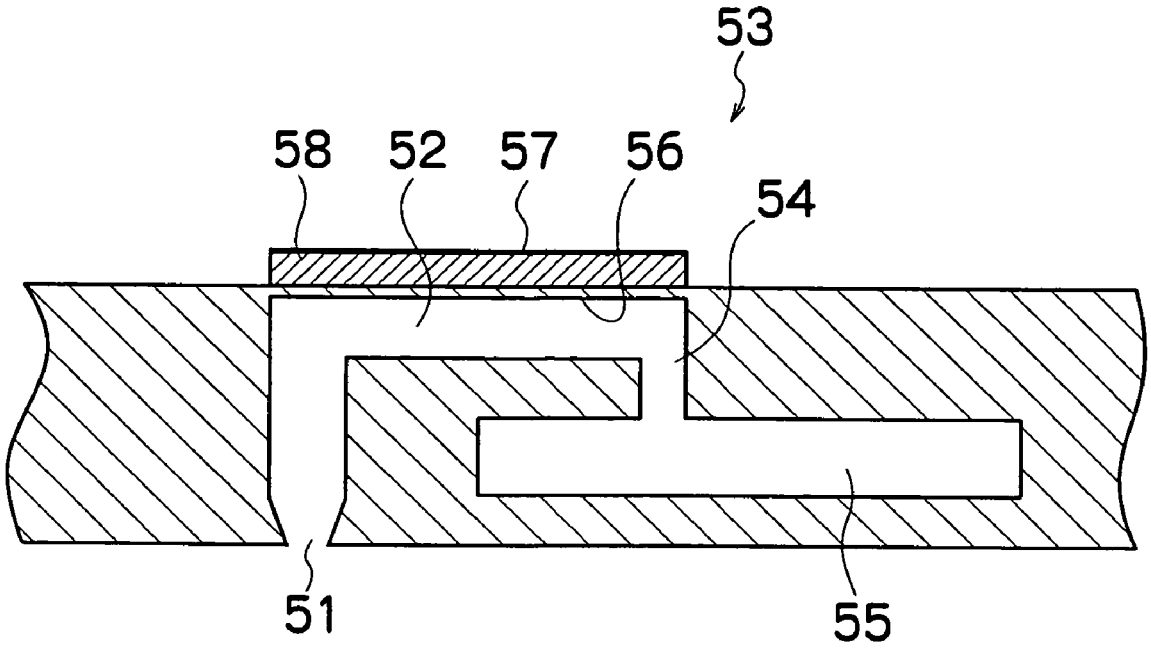
FIG. 5 is a cross-sectional diagram along line 5-5 in FIGS. 4A and 4B.

FIG. 4A is a plan view perspective diagram showing an example of the structure of a head 50, and FIG. 4B is an enlarged diagram of a portion of same. Furthermore, FIG. 4C is a plan view perspective diagram showing a further example of the composition of a print head 50, and FIG. 5 is a cross-sectional diagram showing a three-dimensional composition of an ink chamber unit (being a cross-sectional view along line 5-5 in FIGS. 4A and 4B). In order to achieve a high density of the dot pitch printed onto the surface of the recording medium 16, it is necessary to achieve a high density of the nozzle pitch in the head 50. As shown in FIGS. 4A and 4B, the head 50 according to the present embodiment has a structure in which a plurality of ink chamber units 53, each including a nozzle 51 forming an ink droplet ejection hole, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the main scanning direction, which is perpendicular to the paper conveyance direction) is reduced (high nozzle density is achieved).

Embodiments of one or more nozzle rows covering a length corresponding to the full width of the recording medium 16 is not limited to the present embodiment. For instance, instead of the composition in FIG. 4A, as shown in FIG. 4C, a line head having nozzle rows of a length corresponding to the entire length of the recording medium 16 can be formed by arranging and combining, in a staggered matrix, short head blocks 50' having a plurality of nozzles 51 arrayed in a two-dimensional fashion.

The pressure chamber 52 provided corresponding to each of the nozzles 51 is approximately square-shaped in plan view, and a nozzle 51 and a supply port 54 are provided respectively at either corner of a diagonal of the pressure chamber 52. Each pressure chamber 52 is connected via a supply port 54 to a common flow channel 55. The common liquid chamber 55 is connected to an ink supply tank forming an ink source (not shown in FIGS. 4A to 4C, corresponding to the ink storing and loading unit shown by the reference numeral 14 in FIG. 1), and the ink supplied from the ink supply tank is distributed and supplied to the respective pressure chambers 52 via the common liquid chamber 55 shown in FIG. 5.

An actuator 58 provided with an individual electrode 57 is bonded to a pressure plate 56 which forms the upper face of the pressure chamber 52 and also serves as a common electrode, and the actuator 58 is deformed when a drive voltage is supplied to the individual electrode 57, thereby causing ink to be ejected from the nozzle 51. When ink is ejected, new ink is supplied to the pressure chamber 52 from the common flow passage 55, via the supply port 54.

For the actuator 58 shown in FIG. 5, it is suitable to use a piezoelectric element based on a ceramic material, such as PZT ($Pb(Zr.Ti)O_3$, lead titanate zirconate), and the like. Of course, it is also possible to use piezoelectric elements based on a fluoride resin material, such as PVDF (polyvinylidene fluoride) or PVDF-TrFE (a polyvinylidene fluoride/trifluoride ethylene copolymer).

As shown in FIG. 4B, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a column direction forming an angle of θ with respect to the main scanning direction, the pitch P of the nozzles projected so as to align in the main scanning direction satisfies "$P=d\times\cos\theta$, and hence, in terms of the main scanning direction, the nozzles 51 can be regarded to be equivalent to those arranged linearly at a fixed pitch P. Such configuration makes it possible to achieve a nozzle row having a high nozzle density.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording medium (main-scanning direction) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIGS. 4A and 4B are driven, it is desirable that the "main scanning" is performed in accordance with (3) described above.

On the other hand, the "sub-scanning" is defined as to repeatedly perform printing of one line (a line formed of a row of dots, or a line formed of a plurality of rows of dots) formed by the main scanning, while the full-line head and the recording medium 16 are moved relatively to each other.

In other words, the nozzles 51 which eject ink droplets that are to form dots which are adjacently formed in a mutually overlapping fashion on the recording medium 16, are arranged following a column direction forming an angle of θ with respect to the main scanning direction. However, when embodiments of the present invention are implemented, the arrangement of the nozzles is not limited to that of the example illustrated.

Description of the Control System

Figure 6:
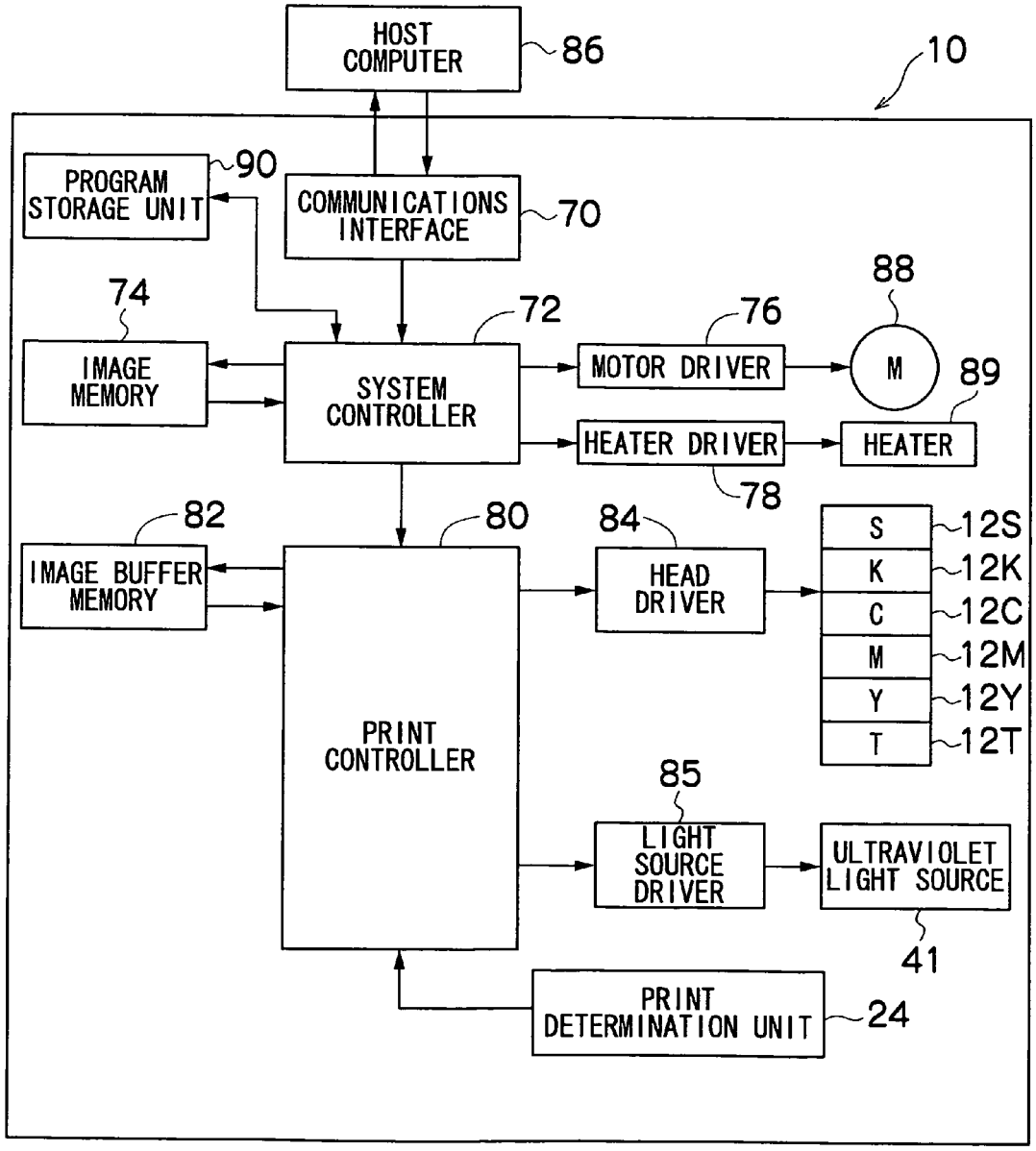
FIG. 6 is a principal block diagram showing the system configuration of the inkjet recording apparatus shown in FIG. 1.

FIG. 6 is a principal block diagram showing the system configuration of the inkjet recording apparatus 10. The inkjet recording apparatus 10 comprises a communication interface 70, a system controller 72, a memory 74, a motor driver 76, a heater driver 78, a print controller 80, an image buffer memory 82, a head driver 84, a light source driver 85, and the like.

The communication interface 70 is an interface unit for receiving image data sent from a host computer 86. A serial interface such as USB, IEEE1394, Ethernet, wireless network, and a parallel interface such as a Centronics interface can be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the memory 74.

The memory 74 is a storage device for temporarily storing images inputted through the communication interface 70, and data is written and read to and from the image memory 74 through the system controller 72. The memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, memory 74, motor driver 76, heater driver 78, and the like, and controls communications with the host computer 86 and writing and reading to and from the memory 74, and it also generates control signals for controlling the motor 88 such as a motor in the conveyance system and the heater 89 such as a heater in the post drying unit 42.

The program executed by the CPU of the system controller 72 and the various types of data which are required for control procedures are stored in the memory 74. The memory 74 may be a non-writeable storage device, or it may be a rewriteable storage device, such as an EEPROM. The memory 74 is used as a temporary storage region for the image data, and it is also used as a program development region and a calculation work region for the CPU.

The motor driver 76 is a driver (drive circuit) which drives the motor 88 in accordance with commands from the system controller 72. The heater driver 78 is a driver which drives the post drying unit 42, and the heater 89 such as the temperature adjustment heater in the inkjet recording apparatus 10 and in the head 50, in accordance with commands from the system controller 72.

The print controller 80 has a signal processing function for performing various tasks, compensations, and other types of processing for generating print control signals on the basis of the image data stored in the memory 74 in accordance with commands from the system controller 72 so as to supply the generated print data (dot data) to the head driver 84. Required signal processing is carried out in the print controller 80, and the ejection amount and the ejection timing of the ink droplets from the respective print heads 50 are controlled via the head driver 84, on the basis of the print data. By this means, desired dot size and dot positions can be achieved.

The print controller 80 is provided with the image buffer memory 82; and image data, parameters, and other data are temporarily stored in the image buffer memory 82 when image data is processed in the print controller 80. Also possible is an aspect in which the print controller 80 and the system controller 72 are integrated to form a single processor.

The head driver 84 drives the actuators 58 of the treatment liquid head 12S, the heads of the respective colors, 12K, 12C, 12M, 12Y, and the transparent ink head 12T, on the basis of print data supplied by the print controller 80. A feedback control system for maintaining constant drive conditions in the head may be included in the head driver 84.

The light source driver 85 functions as a control block which controls the on and off switching of the ultraviolet light source 41 shown in FIGS. 1 and 2 (the illumination timing, illumination time), the irradiation light quantity, and the like. In other words, the on/off switching of the ultraviolet light source 41, and the amount of light irradiated by the ultraviolet light source 41, are set on the basis of the control signal supplied by the print controller 80.

The image data to be printed is externally inputted through the communications interface 70, and is stored in the memory 74. At this stage, RGB image data is stored in the memory 74.

The image data stored in the memory 74 is sent to the print controller 80 via the system controller 72, and in the print controller 80, the droplet ejection region (deposition region) for the treatment liquid, the droplet ejection region for the K, C, M and Y inks, and the droplet ejection region for the transparent ink are determined, and the image data is converted into dot data for each of the K, C, M and Y inks and the transparent ink. In other words, the print controller 80 carries out processing for converting the input RGB image data into dot data of the four colors, K, C, M and Y, processing for converting the image data into dot data for the transparent ink, processing for converting into dot data for the treatment liquid. The respective sets of dot data generated by the print controller 80 are stored in the image buffer memory 82. The details of the droplet ejection control in the inkjet recording apparatus 10 are described hereinafter.

The head driver 84 generates drive control signals for the head 50 on the basis of the dot data stored in the image buffer memory 82. By supplying the drive control signals generated by the head driver 84 to the head 50, droplets of the treatment liquid, the K, C, M and Y inks, and the transparent ink are ejected from the head 50. By controlling droplet ejections from the print heads 50 in synchronization with the conveyance speed of the recording medium 16, an image is formed on the recording medium 16.

Various control programs are stored in the program storage unit 90 shown in FIG. 6, and a control program is read out and executed in accordance with commands from the system controller 72. A semiconductor memory, such as a ROM, EEPROM, a magnetic disk, or the like may be used as the program storage unit 90. An external interface may be provided, and a memory card or PC card may also be used. Naturally, a plurality of these storage media may also be provided. The program storage unit 90 may also serve as a storage device (not illustrated) for storing operational parameters, and the like.

In the present embodiment, the system controller 72, the memory 74, and the print controller 80, and the like, are described as separate functional blocks; however, they may be also integrated to form one single processor. Furthermore, it is also possible to achieve a portion of the functions of the system controller 72 and a portion of the functions of the print controller 80, in one processor.

Description of the Droplet Ejection Control

Figure 7A:
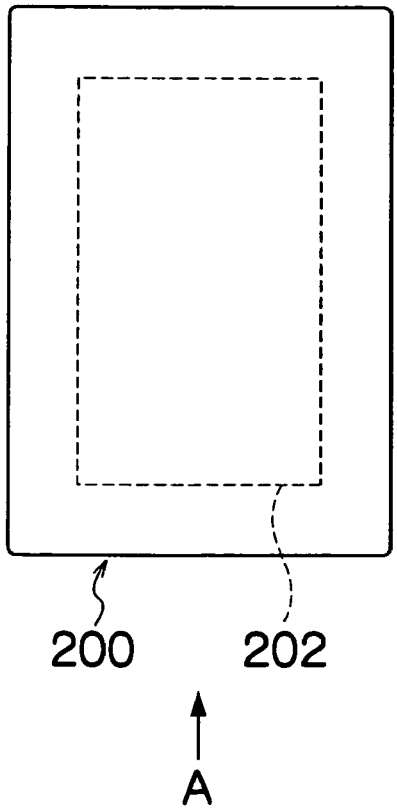
FIGS. 7A and 7B are diagrams showing a treatment liquid deposition region in the droplet ejection control according to an embodiment of the present invention.
Figure 7B:
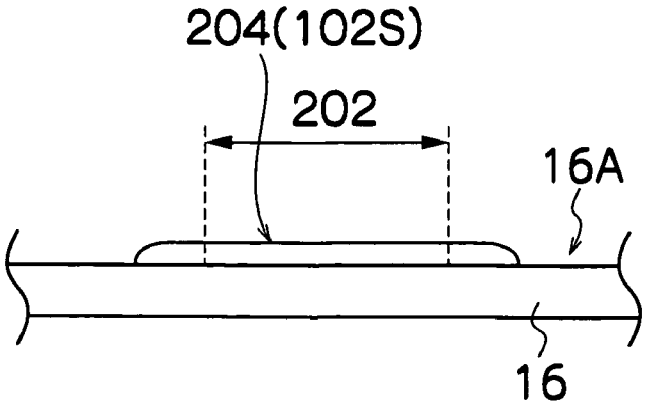

Next, the droplet ejection control (image forming method) according to an embodiment of the present invention is described. FIG. 7A is a plan diagram showing a treatment liquid deposition region 200 and an image forming region 202 set on a recording medium 16 (viewed from the image forming surface 16A side shown in FIG. 7B), and FIG. 7B is a diagram viewed in the direction indicated by an arrow A in FIG. 7A. Reference numeral 200 indicated by the solid line in FIG. 7A indicates a treatment liquid deposition region onto which treatment liquid is deposited. The treatment liquid deposition region 200 is determined so as to be larger than the image forming region 202 (indicated by the broken line) in which printing is carried out by depositing droplets of K, C, M and Y inks (indicated by reference numeral 206 in FIGS. 8A and 8B), the image forming region 202 being specified on the image forming surface of the recording medium 16. The treatment liquid 204 shown in FIG. 7B corresponds to the treatment liquid 102S deposited on the recording medium 16 indicated by reference numeral 102S in FIG. 2.

Figure 8A:
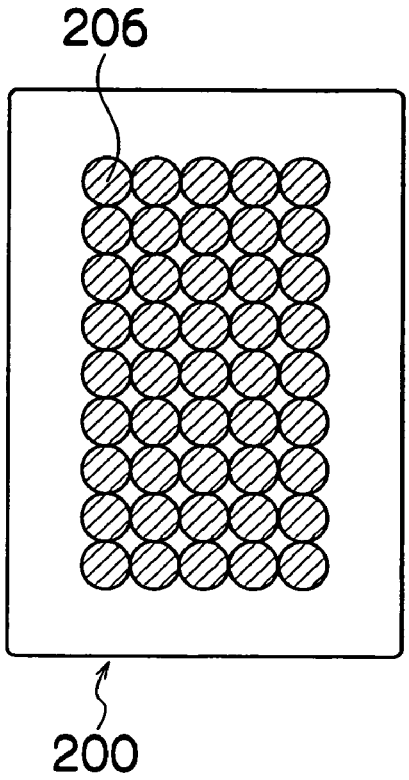
FIGS. 8A and 8B are diagrams showing an image forming region in the droplet ejection control according to an embodiment of the present invention.
Figure 8B:
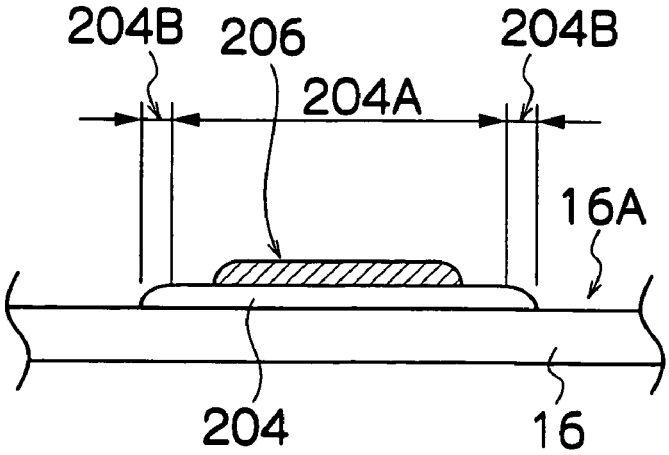

FIGS. 8A and 8B show a state where droplets of K, M, C, and Y inks 206 have been ejected onto the treatment liquid 204 deposited on the recording medium 16. If the treatment liquid 204 has been deposited onto the image forming surface 16A of the recording medium 16 as shown in FIGS. 7A and 7B, then printing is carried out using K, C, M and Y inks 206, on top of the treatment liquid 204 deposited on the recording medium 16, as shown in FIGS. 8A and 8B. In the droplet ejection control shown in the present embodiment, by making the treatment liquid deposition region 200 in which printing is carried out using the treatment liquid 204, as shown in FIG. 8B, larger than the image forming region 202 where printing is carried out using the K, C, M and Y inks, then the K, C, M and Y inks land on a flat region 204A of treatment liquid 204 as shown in FIGS. 8A and 8B (in other words, the K, C, M and Y inks 206 do not land on the peripheral sections 204B of the treatment liquid 204), thereby preventing displacement of the dot formation position caused by movement of the K, C, M and Y inks 206 upon landing (immediately after landing) due to the gradient of the peripheral sections 204B of the treatment liquid 204.

Figure 9A:
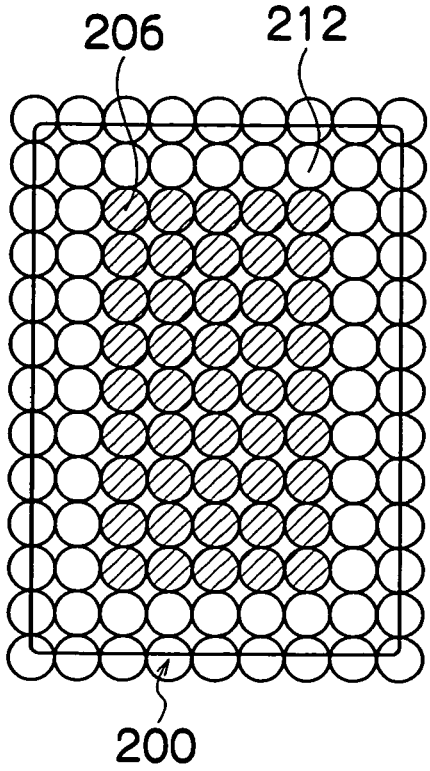
FIGS. 9A and 9B are diagrams showing a transparent ink droplet ejection region in the droplet ejection control according to an embodiment of the present invention.
Figure 9B:
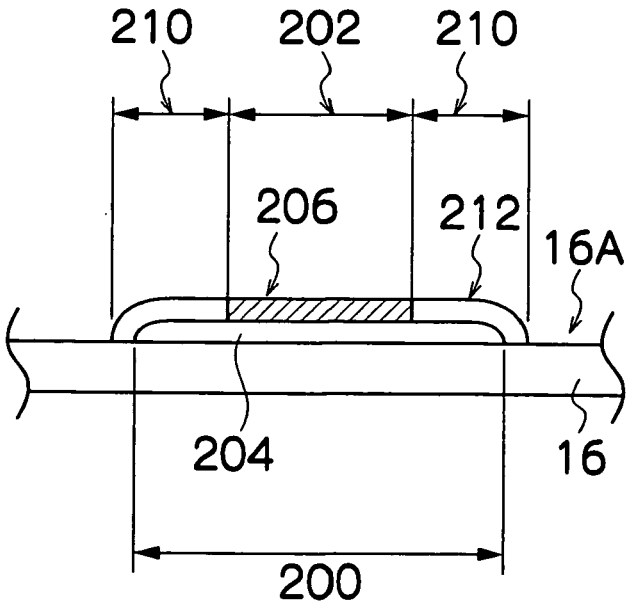

FIGS. 9A and 9B show a state where, after the ejection of droplets of K, C, M and Y inks, droplets of transparent ink 212 have been ejected onto a transparent ink droplet ejection regions 210 (shown in FIG. 9B) which are set, in the treatment liquid deposition region 200, in the peripheral sections of the image forming region 202 where droplets of K, C, M and Y inks have been ejected. In the transparent ink droplet ejection regions shown in FIGS. 9A and 9B, treatment liquid 204 has been applied.

As shown in FIG. 9B, droplets of transparent ink 212 are ejected onto the transparent ink droplet ejection regions 210, which include a region of the treatment liquid deposition region 200 where droplets of K, C, M and Y inks 206 have not been ejected. More specifically, droplets of transparent ink 212 are ejected in such a manner that the treatment liquid deposition region 200, which is set to a broader region than the image forming region 202, is covered completely by at least one of either the K, C, M and Y inks 206, and the transparent ink 212. In other words, droplets of transparent ink 212 are ejected in such a manner that they completely cover at least the non-image forming regions (not shown) which are the regions apart from the image forming region 202, in the treatment liquid deposition region 200.

If droplets of at least one of the K, C, M and Y inks 206 and the transparent ink 212 are ejected onto the treatment liquid 204 deposited on the treatment liquid deposition region 200, then the polymer compound (for example, a monomer, an oligomer, or a compound containing a monomer and an oligomer) contained in the K, C, M and Y inks and the transparent ink, and the polymerization initiator contained in the treatment liquid 204 mix together.

When ultraviolet light is irradiated by the ultraviolet light source 41 shown in FIG. 1, and other drawings, onto this mixed liquid, then a polymerization reaction starts, and the treatment liquid 204, the K, C, M and Y inks 206 and the transparent ink 212 cure and become fixed on the recording medium 16.

Figure 10:
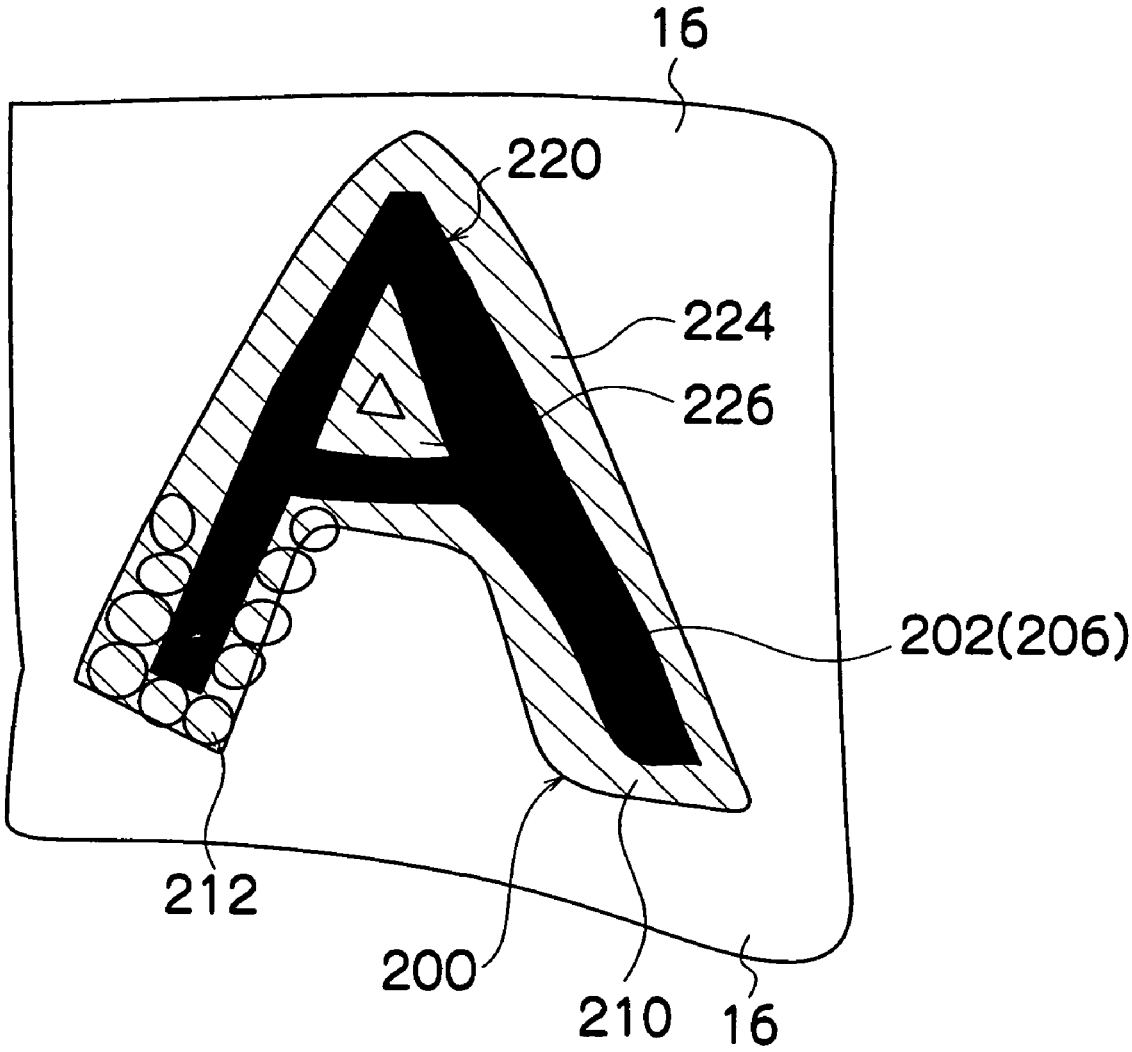
FIG. 10 is a diagram showing an image formed by the image forming method according to an embodiment of the present invention.

FIG. 10 shows a recording medium 16 on which the character "A" (image 220) has been printed. The treatment liquid deposition region 200 (indicated by the diagonal hatching) onto which droplets of treatment liquid 204 have been ejected with respect to the image 220 shown in FIG. 10 is set to the outer edge sections 224 of the "A" character, and the inner side of the central cutaway section 226. In this way, in the example shown in FIG. 10, the treatment liquid deposition region 200 is also set appropriately in the central cutaway section of the "A". In other words, in the present example, the peripheral sections of the image forming region 202 for which a treatment liquid deposition region 200 is set may include the central cutaway section of the image, and the like, as shown in FIG. 10.

Droplets of the K, C, M and Y inks 206 which are required to form the image 220 are ejected appropriately onto the image forming region 202 (indicated by the blacked-out area) shown in FIG. 10. A transparent ink droplet ejection region 210 is determined in such a manner that the whole of the treatment liquid deposition region 200 is covered by the K, C, M and Y inks 206 and the transparent ink 212, and thus droplets of the transparent ink 212 are ejected onto this transparent ink droplet ejection region 210. FIG. 10 shows a portion of the transparent ink 212 which has landed on the transparent ink droplet ejection region 210.

Description of the Droplet Ejection Control Unit

Figure 11:
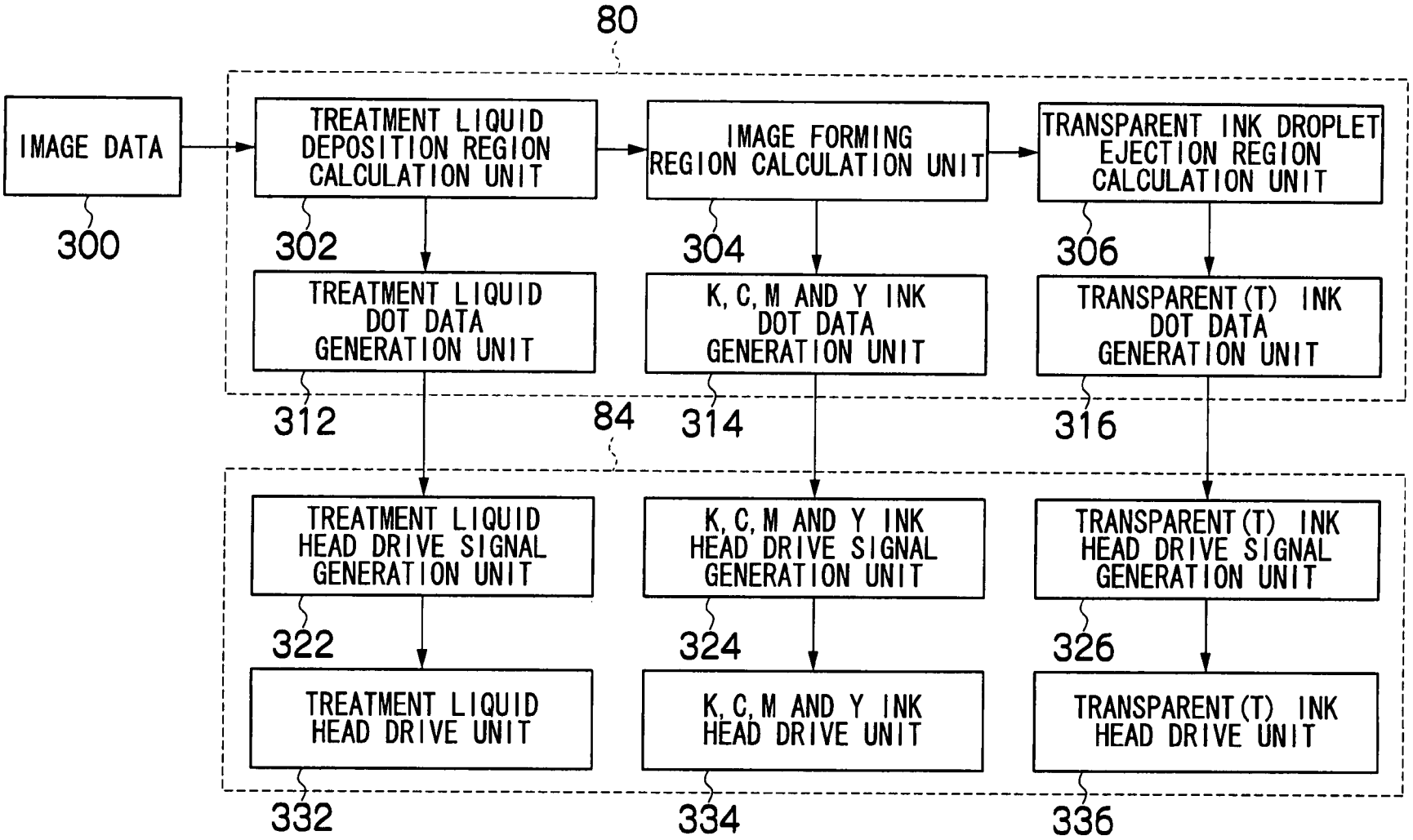
FIG. 11 is a block diagram showing the composition of a droplet ejection control block in the inkjet recording apparatus shown in FIG. 1.

FIG. 11 is a block diagram showing the composition of a droplet ejection control unit which implements the droplet ejection control described above. According to the droplet ejection control shown in the present embodiment, when image data 300 as shown in FIG. 11 is obtained from the host computer 86, or the like, via the communications interface shown in FIG. 6, the treatment liquid deposition region calculation unit 302 determines a treatment liquid deposition region 200 shown in FIG. 7A, and the like, on the basis of the image data 300. Furthermore, the image forming region calculation unit 304 in FIG. 11 determines an image forming region (KCMY droplet ejection region) 202 shown in FIGS. 7A and 8A, and the like. Moreover, the transparent ink droplet ejection region calculation unit 306 in FIG. 11 determines transparent ink droplet ejection regions 210 shown in FIGS. 9A and 9B, and the like.

Desirably, the transparent ink droplet ejection regions 210 shown in FIGS. 9A and 9B and the like are determined so as not to overlap with the image forming region 202. Furthermore, it may also include sections to the outer side of the outer edge of the treatment liquid deposition region 200 shown in FIGS. 7A and 7B, or the like, and sections to the inner side of the inner edge of same.

In other words, by ejecting droplets of transparent ink 212 onto sections to the outer side of the outer edge of the treatment liquid deposition region 200, and to the inner side of the inner edge of same, it is possible to prevent the existence of unreacted treatment liquid 204 in the vicinity of the outer edge or the vicinity of the inner edge of the treatment liquid deposition region 200. Furthermore, it is also possible to set the treatment liquid deposition region 200 so as to be the whole of the possible image forming region of the recording medium 16. In this case, the consumption of treatment liquid 204 and transparent ink 212 increases, and hence a desirable mode is one in which the treatment liquid deposition region 200 is set to the vicinity of the image forming region 202 (namely a range of several dots to the outer side of the outer edge sections and to the inner side of the inner edges of the image forming region 202).

Furthermore, more desirably, the treatment liquid deposition region 200 is determined by taking account of error in the landing positions of the treatment liquid 204 and the transparent ink 212.

When the treatment liquid deposition region 200, the image forming region 202, and the transparent ink droplet ejection region 210 have been determined in this way, then the treatment liquid dot data generation unit 312, the KCMY ink dot data generation unit 314 and the transparent ink dot data generation unit 316 shown in FIG. 11 calculate dot data for the treatment liquid 204, the K, C, M and Y inks 206, and the transparent ink 212 respectively.

To give an example of the treatment liquid deposition region 200, the image forming region 202 and the transparent ink droplet ejection region 210, as shown in FIGS. 9A and 9B, the treatment liquid deposition region 200 is set to a range of 1.5 dots about the periphery of the image forming region 202, and the transparent ink droplet ejection region 210 is set to a range of 2 dots about the periphery of the image forming region 202.

The relationship among the treatment liquid deposition region 200, the image forming region 202 and the transparent ink droplet ejection region 210 is changed appropriately in accordance with the type of the recording medium 16, and the physical properties values of the treatment liquid 204, the K, C, M and Y inks 206, and the transparent ink 212. For example, if the surface tensions of the K, C, M and Y inks 206 and the transparent ink are large with respect to the treatment liquid, then the treatment liquid deposition region 200 is desirably determined to be a broader area.

On the basis of the dot data for the treatment liquid 204, the K, C, M and Y inks 206 and the transparent ink 212 generated in this way, drive signals are generated by a treatment liquid head drive signal generation unit 322, a K, C, M and Y ink head drive signal generation unit 324, and a transparent ink head drive signal generation unit 326. The respective drive signals are subjected to prescribed signal processing by a treatment liquid head drive unit 332, a KCMY ink drive unit 344 and a transparent ink head drive unit 336, and are then supplied to the actuators 58 (shown in FIG. 5) provided in the heads 12S, 12K, 12C, 12M, 12Y and 12T shown in FIG. 6.

For example, there is a mode in which drive signals of digital data are generated in the treatment liquid head drive signal generation unit 322 and the K, C, M and Y ink head drive signal generation unit 324, and processing such as A/D conversion, amplification, and the like, is carried out on these digital data drive signals, in the treatment liquid head drive unit 332, the K, C, M and Y ink head drive unit 334, and the transparent ink head drive unit 336.

In the present embodiment, the treatment liquid deposition region calculation unit 302, the image forming region calculation unit 304, the transparent ink droplet ejection region calculation region 306, the treatment liquid dot data generation unit 312, the K, C, M and Y ink dot data generation unit 314, and the transparent ink dot data generation unit 316 shown in FIG. 11 are incorporated into the print controller 80 shown in FIG. 6, and the treatment liquid head drive signal generation unit 322, the K, C, M and Y ink head drive signal generation unit 324, the transparent ink head drive signal generation unit 326, the treatment liquid head drive unit 332, the K, C, M and Y ink head drive unit 334, and the transparent ink head drive unit 336 are incorporated into the head driver 84 shown in FIG. 6.

Of course, the composition of the droplet ejection control unit described above is merely an example, and it may be changed appropriately (or a function may be added or removed), in accordance with the composition of the print controller 80 and the head driver 84 shown in FIG. 6.

Description of the Treatment Liquid, K, C, M and Y Inks, and Transparent Ink

Next, an ink set used in the inkjet recording apparatus 10 according to the present embodiment is described below. The ink set used in the present embodiment includes the treatment liquid (reference numeral 202 in FIG. 7A, and the like), the K, C, M and Y inks (reference numeral 206 in FIG. 8A, and the like), and the transparent ink (reference numeral 212 in FIG. 9A), each of which are described above.

More specifically, in the present embodiment, liquids of various types including the treatment liquid 204, the K, C, M and Y inks 206, and the transparent ink 212 are used as the ink set, and an image is formed by depositing the treatment liquid 204, the K, C, M and Y inks 206 and the transparent ink 212 on the recording medium 16, simultaneously, or by depositing one of these liquids first and depositing another subsequently, in such a manner that the liquids make contact with each other. By depositing the treatment liquid 204 which contains a polymerization initiator, K, C, M and Y inks 206 which contains ink coloring material and a polymer compound, and the transparent ink 212 which contains a polymer compound but does not contain ink coloring material, it is possible to effectively suppress bleeding or landing interference.

From the viewpoint of further suppressing the occurrence of bleeding and landing interference, the treatment liquid used in the present embodiment contains a high-boiling-point organic solvent which has a viscosity at 25° C. of 100 mPa·s or below and a viscosity at 60° C. of 30 mPa·s or below (Condition 1), and has a boiling point exceeding 100° C. (Condition 2). The treatment liquid also contains a dispersion inhibitor and a polymerization initiator, which prevent the spreading of the K, C, M and Y inks (the dots formed by the K, C, M and Y inks) after K, C, M and Y inks have landed on the treatment liquid.

In the case of a high-boiling-point organic solvent which does not satisfy either of the viscosity conditions stated in the above Condition 1, the viscosity is high and the solvent may inhibit the deposition of liquid onto the recording medium. On the other hand, in the case of a high-boiling-point organic solvent which does not satisfy the boiling-point conditions stated in the above Condition 2, the boiling point is too low, and hence the solvent evaporates during image formation and this may impede the effects of preventing landing interference according to the present embodiment. Furthermore, the evaporation and dispersion into the atmosphere of this solvent is undesirable from an environmental point of view.

With regard to the conditions stated in the above Condition (1), more desirably, the viscosity at 25° C. is 70 mPa·s or below, even more desirably, it is 40 mPa·s or below, and especially desirably, it is 20 mPa·s or below. Desirably, the viscosity at 60° C. is 20 mPa·s or below, and especially desirably, it is 10 mPa·s or below. Here, the "viscosity" according to embodiments of the present invention is the viscosity found by using a RE80 type viscometer manufactured by Toki Sangyo Co., Ltd. The RE80 viscometer is based on a conical rotor/flat plate measurement system equivalent to an E type, and measurement is carried out on the basis of a Code No. 1 rotor, at a rotational speed of 10 rpm. In the cases of material having a viscosity greater than 60 mPa·s, according to requirements, measurement is carried out by changing the rotational speed to 5 rpm, 2.5 rpm, 1 rpm, 0.5 rpm, and the like.

Furthermore, with regard to the boiling point in the above Condition (2), more desirably, the boiling point is 150° C. or above, and especially desirably, 170° C. or above. Moreover, desirably, the high-boiling-point organic solvent has a melting point of 80° C. or below, and a water solubility (at 25° C.) is 4 g or less. More desirably, the water solubility is 3 g or less, even more desirably, it is 2 g or less, and especially desirably, 1 g or less. Here, the "water solubility" according to the present embodiment is the saturated density of water in the high-boiling point organic solvent at 25° C., and it means the mass (g) of water that can be dissolved per 100 g of the high-boiling-point organic solvent at 25° C.

In the present embodiment, desirable physical properties for liquid (inks) ejected as droplets onto the recording medium 16 are a viscosity of 5 to 100 mPa·s in each liquid, and more desirably, a viscosity of 10 to 80 mPa·s. Desirably, the surface tension of the ink composition is 20 to 60 mN/m, and more desirably, 30 to 50 mN/m.

With regard to even more desirable properties, desirably, each of a viscosity difference between the treatment liquid 204 and the K, C, M and Y inks 206, and a viscosity difference between the treatment liquid 204 and the transparent ink 212, is 25 mPa·s or less. Desirably, each of a surface tension difference between the treatment liquid 204 and the K, C, M and Y inks 206, and a surface tension difference between the treatment liquid 204 and the transparent ink 212, is 20 mN/m or less. Furthermore, there are no particular restrictions on the mass of the liquid droplets, which is selected in accordance with the sharpness of the image to be formed, but in general, desirably, the mass per droplet of one liquid is approximately 0.5 pl to 10 pl.

When droplets of the treatment liquid 204 are ejected from the treatment liquid head 12S prior to the K, C, M and Y inks 206 and the transparent ink 212, then landing interference occurs due to the fact that the treatment liquid 204 itself makes direct contact with the recording medium 16, and the peripheral sections of the ejected liquid droplets have a ragged shape. However, since the treatment liquid does not contain any coloring material, this occurrence of landing interference does not cause problems.

Furthermore, since the droplets of K, C, M and Y inks 206 are ejected so as to make contact with the treatment liquid 204 on the recording medium 16 onto which the treatment liquid 204 has already been deposited, then landing interference does not occur between the droplets of the K, C, M and Y inks (either between inks of the same color or between inks of different colors), and hence the dot shapes formed by the ink droplets are preserved.

The K, C, M and Y inks 206 including ink coloring material, and the transparent ink 212 which does not contain coloring material, contain at least one polymer compound of an ultraviolet-curable monomer, an ultraviolet-curable oligomer, and a combination of these.

When the K, C, M and Y inks 206 and the transparent ink 212 land on the treatment liquid 204, and the K, C, M and Y inks 206 and the transparent ink 212 make contact with the treatment liquid 204, then landing interference of the K, C, M and Y inks 206 is prevented and the polymerization initiator in the treatment liquid 204 mixes with the K, C, M and Y inks 206 and the transparent ink 212. When ultraviolet light is irradiated onto this mixed liquid, the mixed liquid (namely, the treatment liquid 204, the K, C, M and Y inks 206, and the transparent ink 212) cures and becomes fixed onto the recording medium 16.

In an embodiment where only the treatment liquid 204 contains a polymerization initiator, even if leaked light of ultraviolet light irradiated from the ultraviolet light source 41 reaches the heads 12K, 12C, 12M, 12Y and 12T which eject droplets of K, C, M and Y inks 206 and transparent ink 212, the ink in the nozzles 51 (shown in FIG. 5) of the heads 12K, 12C, 12M, 12Y and 12T is not cured, and therefore it is possible to prevent blocking of the nozzles of the heads 12K, 12C, 12M, 12Y and 12T.

In the ink set used in the present example, a polymerization initiator may also be included in the K, C, M and Y inks 206 and the transparent ink 212. In a two-liquid system where inks (in the present embodiment, the K, C, M and Y inks 206 containing ink coloring material, and the transparent ink 212 which does not contain coloring material) and a treatment liquid 204 which does not contain a polymerization initiator are used, desirably, the balance in the amount of liquid deposited per droplet onto the image forming region (indicated by reference numeral 202 in FIGS. 7A and 7B) of the recording medium 16 is such that, taking the deposition amount of the K, C, M and Y inks 206 and the deposition amount of the transparent ink to be 1, the deposition amount (mass ratio) of the treatment liquid is in the range of 0.05 to 5, more desirably, the range of 0.07 to 1, and even more desirably, the range of 0.1 to 1. By setting the ratio of the transparent ink 212 with respect to the K, C, M and Y inks 206 to be 5 or less, superior image quality can be obtained from the viewpoint of relief effects, and furthermore, by setting the ratio to be 0.05 or above, then a suitable effect in preventing landing interference, which is the beneficial effect of the present embodiment, can be obtained.

Furthermore, if each of the K, C, M and Y inks 206 and the transparent ink 212 contains a polymerization initiator, then if leaked light of ultraviolet light irradiated from the ultraviolet light source 41 shown in FIG. 1 reaches the nozzle forming surface (ejection surface) of the heads 12K, 12C, 12M, 12Y and 12T, the ink inside the nozzles 51 undergoes a polymerization reaction and becomes cured inside the nozzles 51 of the heads 12K, 12C, 12M, 12Y and 12T, thus giving rise to ink blockages in the nozzles 51. In particular, in the case of the transparent ink head 12T which is closest to the ultraviolet light source 41, the leaked light of the ultraviolet light irradiated from the ultraviolet light source 41 is more likely to reach the head 12T than the other heads, and hence there is a greater probability that the ink inside the nozzles 51 cures due to leaked light of this kind. Therefore, in a mode where the K, C, M and Y inks 206 and the transparent ink 212 contain a polymerization initiator, it is desirable to provide a shielding member which shuts out the leaked ultraviolet light, between the ultraviolet light source 41, and the heads 12K, 12C, 12M, 12Y and 12T.

To give examples of the shielding member described above, it is possible to install a shielding plate between the ultraviolet light source 41 and the transparent ink head 12T, and it is also possible to provide shutter mechanisms on the nozzle forming surfaces of the heads 12K, 12C, 12M, 12Y and 12T, the opening and shutting of the shutter mechanisms being controlled in accordance with the irradiation timing of the ultraviolet light source 41 and the droplet ejection timing of the heads 12K, 12C, 12M, 12Y and 12T.

Furthermore, it is possible to adopt a composition in which a polymerization initiator is included in the treatment liquid 204 and the transparent ink 212. By including a polymerization initiator in the transparent ink, it is possible to ensure that the transparent ink 212 cures reliably, and furthermore, it is also possible to prevent nozzle blockages caused by leaked light of ultraviolet light irradiated from the ultraviolet light source 41, in the heads 12K, 12C, 12M and 12Y corresponding to the K, C, M and Y inks 206.

It is also possible to adopt a composition in which, instead of transparent ink 212, an ink of the same color (or the similar color type) as the recording medium 16 is used, in such a manner that it completely covers at least the non-image forming region. Here, the "similar color type" includes light inks, dark inks, and the like, and for example, if the color of the recording medium 16 is cyan, then a composition can be adopted in which a cyan or light cyan ink is used instead of the transparent ink 212.

Description of Curing Energy

In the inkjet recording apparatus 10 according to the present embodiment, with a view to obtaining excellent fixing properties, a process is implemented for fixing an image on the recording medium 16 by applying energy after image formation.

In other words, by applying energy to the mixed liquid combining treatment liquid 204, the K, C, M and Y inks 206, and the transparent ink 212 deposited on the recording medium 16, it is possible to form a strongly fixed and resilient image, efficiently, by means of polymerization and curing reactions. In the present embodiment, this application of energy is performed by irradiating radiation, such as ultraviolet light.

In other words, the generation of active material (active species) caused by the decomposition of the polymerization initiator in the mixed liquid is promoted by the energy (ultraviolet light) given by the ultraviolet light source 41, and furthermore, the polymerization and curing reaction of the polymer compound caused by the active material is promoted, by increase in the active material and increase in the temperature.

In the present embodiment, an ultraviolet light source is described as one example of an exposure light source for promoting the polymerization of the polymer compound. Besides this embodiment, it is also possible to apply energy by irradiating visible light, α rays, γ rays, X rays, an electron beam, or the like, and of these, ultraviolet light and visible light are desirable from the viewpoint of cost and safety, and ultraviolet light is particularly desirable. The amount of energy required for the curing reaction varies depending on the type and the contained amount of the polymerization initiator, and in general, it is about 1 to 500 $mJ/cm^2$.

Description of the Recording Medium

In embodiments of the present invention, it is possible to use an ink-permeable type of recording medium and an non-ink-permeable type of recording medium. Examples of ink-permeable recording media include: normal paper, paper for inkjet printing, coated paper, electronic photographic paper, cloth, non-woven cloth, porous film, high-polymer absorbing body, and the like. These are described as "recording media" in Japanese Patent Application Publication No. 2001-1891549, and the like.

The outstanding beneficial effects of embodiments of the present invention are notably seen in the cases of recording media which have slow ink permeability or zero ink permeability. Examples of recording media which have slow or zero permeability for ink include art paper, synthetic resin, rubber, resin-coated paper, glass, metal, ceramic, wood, and the like. In order to add other functions, it is also possible to use a composite base material in which some or all of these materials are combined.

For the synthetic resin, it is possible to use any type of synthetic resin, and typical examples include: polyethylene terephthalate, polybutadiene terephthalate or other polyesters, polyvinyl chloride, polystyrene, polyethylene, polyurethane, polypropylene or other polyolefins, acrylic resins, polycarbonate, acrylonitrile-butadiene styrene copolymer, diacetate, triacetate, polyimide, cellophane, celluloid, and the like. There are no restrictions on the thickness and shape of these synthetic resin base materials, and they may have a film shape, a card shape, or a block shape, or the like. Furthermore, the synthetic resin may be transparent or it may be opaque.

For the mode of using synthetic resin, it is desirable to use the resin in the form of a film as used in so-called soft packages, and it is possible to use various types of non-absorbent plastics or non-absorbent plastic films. Examples of such plastic films include PET film, OPS film, OPP film, PNy film, PVC film, PE film, TAC film, and the like. Other plastics may also be used, such as polycarbonate, acrylic resin, ABS, polyacetal, PVA, rubber, or the like.

As a resin-coated paper, for example, it is possible to use papers, such as a transparent polyester film, an opaque polyester film, an opaque polyolefin resin film, a paper support body having polyolefin resin covering both surfaces of the paper, or the like, and the paper support body having polyolefin resin covering both surfaces of the paper is especially desirable.

As regards the metal, any type of metal can be used, and it is desirable to use metals such as aluminum, steel, gold, silver, copper, nickel, titanium, chromium, molybdenum, silicon, lead, zinc, and a composite material combining these with stainless steel, or the like.

For the recording medium used in embodiments of the present invention, it is possible to use read-only optical disks, such as a CD-ROM and DVD-ROM, a write-once type of optical disk, such as a CD-R or DVD-R, or a rewriteable optical disk. It is also possible to provide an ink accommodating layer and a gloss application layer onto the label surface of such disks.

Further Embodiments

The treatment liquid 204 does not necessarily have to be deposited on the recording medium 16 in the form of droplets ejected from a treatment liquid head 12S, and it may also be deposited by another device. From the viewpoint of suppressing bleeding or landing interference, it is desirable that droplets of K, C, M and Y inks 206 and transparent ink 212 are ejected from the nozzles 51 of the heads 12K, 12C, 12M, 12Y, 12T, simultaneously with or after the deposition of the treatment liquid 204 onto the recording medium 16.

As modes of depositing the treatment liquid 204 on the recording medium 16, an application member of simple composition which applies treatment liquid by making soft roller contact the recording medium 16, may be provided, and an application apparatus may also be provided. There are no particular restrictions on the application apparatus, and a commonly known application apparatus may be appropriately selected in accordance with the desired objectives. Examples of application apparatuses include: an air doctor coater, a blade coater, a rod coater, a knife coater, a squeeze coater, an immersion coater, a reverse roll coater, a transfer roll coater, a gravure coater, a kiss roll coater, a cast coater, a spray coater, a curtain coater, an extrusion coater, and the like. For more details, we can refer to a document "Coating Engineering" attributed to Yuji Harazaki. Furthermore, a mode in which a treatment liquid head 12S and an application device are jointly used, is also possible.

In the embodiments described above, one treatment liquid head 12S is disposed on the furthest upstream side of the print unit 12 (see FIG. 2); however, it is also possible to integrate the treatment liquid head 12S with the furthest upstream side head of the heads 12K, 12C, 12M, 12Y and 12T corresponding to the K, C, M and Y inks 206 and the transparent ink 212. In other words, a composition is possible in which droplets of treatment liquid 204 are ejected from a portion of the nozzles 51 provided in one head, and droplets of K, C, M and Y inks 206 and transparent ink 212 are ejected from the remaining nozzles 51. Moreover, it is also possible to adopt a composition in which the treatment liquid head 12S, the K, C, M and Y ink heads 12K, 12C, 12M, 12Y, and the transparent ink head 12T, are formed in an integrated fashion.

The treatment liquid 204 is deposited in a substantially uniform fashion (substantially evenly) on the prescribed region of the recording medium 16 (the treatment liquid deposition region shown in FIGS. 7A and 7B), and therefore, a high-density dot formation is not required for the treatment liquid in comparison with the K, C, M and Y inks 206 and the transparent ink 212. Consequently, the treatment liquid head 12S may also be composed with a reduced number of nozzles (a reduced nozzle density) in comparison with the K, C, M and Y ink heads 12K, 12M, 12C and 12Y, and the transparent ink head 12T.

It is also possible to adopt a composition in which the nozzles of the treatment liquid head 12S are larger in diameter than the nozzles of the KCMY ink heads 12K, 12C, 12M, 12Y, and the transparent ink head 12T. By making the diameter of the nozzles of the treatment liquid head 12S larger, it is possible to eject droplets of treatment liquid 204 having a higher consistency (viscosity).

Furthermore, the transparent ink 212 is ejected so as to cover completely the whole of the treatment liquid deposition region 200 (see FIGS. 7A and 7B, or the like) where treatment liquid 204 has been deposited, and therefore, a high-density dot formation is not required for the transparent ink in comparison with the K, C, M and Y inks. Consequently, the transparent ink head 12T may also have a smaller number of nozzles (a lower nozzle density) than the KCMY ink heads 12K, 12C, 12M and 12Y, and it may also have nozzles of larger diameter.

In this way, by increasing the nozzle diameter of the treatment liquid head 12S which ejects droplets of treatment liquid 204, and by increasing the nozzle diameter of the transparent ink head 12T, in comparison with the heads 12K, 12C, 12M and 12Y which eject droplets of K, C, M and Y inks 206, it can be expected to make manufacturing of the treatment liquid head 12S and the transparent ink head 12T more easy.

If the landing position error in the treatment liquids 204 and the transparent inks 212 is taken into account, then a desirable mode is one in which the nozzle densities of the treatment liquid head 12S and the transparent ink head 12T are substantially the same, and furthermore, it is also desirable that the treatment liquid head 12S and the transparent ink head 12T have substantially the same nozzle diameter.

If it is difficult to cover the treatment liquid deposition region completely with the K, C, M and Y inks 206 and the transparent ink 212, due to landing variation in the treatment liquid 204 and the transparent ink 212, then uncured treatment liquid can remain. Therefore, desirably, the treatment liquid deposition region 200 and the transparent ink droplet ejection region 210 are determined in such a manner that the outer edge section (inner edge section) of the transparent ink droplet ejection region 210 lies to the outer side of the outer edge section of the treatment liquid deposition region 200.

Furthermore, embodiments are described above in which the K, C, M and Y ink heads 12K, 12C, 12M and 12Y are provided on the upstream side of the print unit 12, and a transparent ink head 12T is provided after the K, C, M and Y ink heads 12K, 12C, 12M and 12Y (on the downstream side); however, it is also possible to provide the transparent ink head 12T on the upstream side of the K, C, M and Y ink heads 12K, 12C, 12M and 12Y (before the K, C, M and Y ink heads 12K, 12C, 12M and 12Y).

In other words, it is possible to adopt a composition in which droplets of transparent ink 212 are ejected so as to cover completely the non-image forming region (not illustrated), which is a region other than the image forming region 202 where droplets of the K, C, M and Y inks 206 are to be ejected, of the region of the treatment liquid deposition region 200 onto which treatment liquid 204 has been deposited on the recording medium 16, whereupon droplets of the K, C, M and Y inks 206 are subsequently ejected onto the image forming region 202.

According to the composition described above, by ejecting droplets of transparent ink 212 prior to the K, C, M and Y inks 206, it is possible to suppress unwanted spreading of the K, C, M and Y inks 206 when they land, and hence degradation of image quality caused by dot spreading can be prevented.

The inkjet recording apparatuses 10 having the composition described above is inkjet recording apparatuses based on a two-liquid system in which an image is formed on a recording medium 16 by using a treatment liquid 204 containing a polymerization initiator, a dispersion inhibitor, and a high-boiling-point organic solvent, K, C, M and Y inks 206 containing an ink coloring material, and at least one of an ultraviolet-curable monomer, an ultraviolet-curable oligomer, and a combination of same, and a transparent ink 212. In these inkjet recording apparatuses, the treatment liquid 204 is deposited onto a treatment liquid deposition region 200 which is set to be wider than the image forming region 202 where droplets of the K, C, M and Y inks 206 are ejected onto the recording medium 16. Consequently, landing interference is prevented due to the fact that the K, C, M and Y inks 206 land on the treatment liquid, and it is also possible to prevent degradation of the image quality caused by displacement of the dot positions due to movement of the K, C, M and Y inks 206 arising when the inks 206 land on undulations (inclined sections) at the peripheral sections of the treatment liquid 204. Furthermore, since droplets of transparent ink 212 are ejected in such a manner that the transparent ink 212 covers completely the region of the treatment liquid deposition region 200 onto which droplets of the K, C, M and Y inks have not been ejected, then it is possible to prevent an unreacted treatment liquid 204 remaining on the recording medium 16.

Moreover, after ejecting droplets of the K, C, M and Y inks 206 and the transparent ink 212 so as to cover completely the treatment liquid deposition region 200, the K, C, M and Y inks 206 and the transparent ink 212 are cured by being irradiated with ultraviolet light, thus fixing the image formed on the recording medium 16.

In the foregoing embodiments, an inkjet recording apparatus 10 using page-wide full line type heads 50 (12K, 12C, 12M and 12Y) having nozzle rows of a length corresponding to the entire width of the recording medium 16 is described; however, the scope of application of the present invention is not limited to this. The present invention may also be applied to an inkjet recording apparatus using a shuttle head which performs image recording while a recording head of short dimensions is moved in a reciprocal fashion.

In the foregoing embodiments, an inkjet recording apparatus 10 for forming images on a recording medium 16 by ejecting ink from nozzles 51 provided in a head (inkjet head) 50 is described; however, the scope of application of the present invention is not limited to this. The present invention may also be applied broadly to image forming apparatuses which form images (three-dimensional shapes) by means of a liquid other than ink, such as resist, and to liquid ejection apparatuses, such as dispensers which eject liquid chemicals (drug solution), water, or the like, from nozzles (ejection holes).

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming method comprising the steps of:

depositing a first liquid containing at least a dispersion inhibitor, a polymerization initiator, and a high-boiling-point organic solvent, onto an image forming region of a recording medium where an image is to be formed according to image data, and onto a peripheral region of the image forming region;

ejecting a second liquid containing at least a radiation-curable polymer compound and a coloring material, onto the recording medium according to the image data after the first liquid is deposited onto the image forming region and the peripheral region of the image forming region;

ejecting a third liquid containing at least a radiation-curable polymer compound, onto at least the peripheral region of the image forming region after the first liquid is deposited onto the image forming region and the peripheral region of the image forming region, the third liquid being a transparent color, the same color as the recording medium, or a similar color to the recording medium; and irradiating radiation onto the first liquid, the second liquid and the third liquid on the recording medium.

2. The image forming method as defined in claim 1, wherein the third liquid contains a polymerization initiator.

3. An image forming method comprising the steps of:

depositing a first liquid containing at least a dispersion inhibitor and a high-boiling-point organic solvent, onto an image forming region of a recording medium where an image is to be formed according to image data, and onto a peripheral region of the image forming region;

ejecting a second liquid containing at least a radiation-curable polymer compound, a polymerization initiator, and a coloring material, onto the recording medium according to the image data after the first liquid is deposited onto the image forming region and the peripheral region of the image forming region;

ejecting a third liquid containing at least a radiation-curable polymer compound and a polymerization initiator, onto at least the peripheral region of the image forming region after the first liquid is deposited onto the image forming region and the peripheral region of the image forming region, the third liquid being a transparent color, the same color as the recording medium, or a similar color to the recording medium; and irradiating radiation onto the first liquid, the second liquid and the third liquid on the recording medium.

4. The image forming method as defined in claim 1, wherein timing of ejecting the third liquid onto at least the peripheral region of the image forming region is substantially the same as timing of ejecting the second liquid onto the recording medium, or is after the timing of ejecting the second liquid onto the recording medium.

5. The image forming method as defined in claim 3, wherein timing of ejecting the third liquid onto at least the peripheral region of the image forming region is substantially the same as timing of ejecting the second liquid onto the recording medium, or is after the timing of ejecting the second liquid onto the recording medium.

6. The image forming method as defined in claim 1, wherein timing of ejecting the second liquid onto the recording medium is substantially the same as timing of ejecting the third liquid onto at least the peripheral region of the image forming region, or is after the timing of ejecting the third liquid onto at least the peripheral region of the image forming region.

7. The image forming method as defined in claim 3, wherein timing of ejecting the second liquid onto the recording medium is substantially the same as timing of ejecting the third liquid onto at least the peripheral region of the image forming region, or is after the timing of ejecting the third liquid onto at least the peripheral region of the image forming region.

8. An image forming apparatus comprising:

a first liquid deposition device depositing a first liquid containing at least a dispersion inhibitor, a polymerization initiator, and a high-boiling-point organic solvent, onto an image forming region of a recording medium where an image is to be formed according to image data, and onto a peripheral region of the image forming region;

a second liquid ejection device ejecting a second liquid containing at least a radiation-curable polymer compound and a coloring material, onto the recording medium according to the image data;

a third liquid ejection device ejecting a third liquid containing at least a radiation-curable polymer compound, onto at least the peripheral region of the image forming region, the third liquid being a transparent color, the same color as the recording medium, or a similar color to the recording medium; and a radiation irradiation device irradiating radiation onto the first liquid, the second liquid and the third liquid on the recording medium.

9. The image forming method as defined in claim 8, wherein the third liquid contains a polymerization initiator.

10. An image forming apparatus, comprising:

a first liquid deposition device depositing a first liquid containing at least a dispersion inhibitor and a high-boiling-point organic solvent, onto an image forming region of a recording medium where an image is to be formed according to image data, and onto a peripheral region of the image forming region;

a second liquid ejection device ejecting a second liquid containing at least a radiation-curable polymer compound, a polymerization initiator, and a coloring material, onto the recording medium according to the image data;

a third liquid ejection device ejecting a third liquid containing at least a radiation-curable polymer compound and a polymerization initiator, onto at least the peripheral region of the image forming region, the third liquid being a transparent color, the same color as the recording medium, or a similar color to the recording medium; and a radiation irradiation device irradiating radiation onto the first liquid, the second liquid and the third liquid on the recording medium.

* * * * *